US010254036B2

(12) United States Patent
Lim et al.

(10) Patent No.: US 10,254,036 B2
(45) Date of Patent: Apr. 9, 2019

(54) REFRIGERATOR

(71) Applicant: SAMSUNG ELECTRONICS CO., LTD., Suwon-si, Gyeonggi-do (KR)

(72) Inventors: Chang Hak Lim, Hwaseong-si (KR); Sung Bok Ko, Hwaseong-si (KR); Ju Young Kim, Suwon-si (KR); Hyun Joo Kim, Suwon-si (KR); Dongo Yang, Gwangju (KR); Il Hyeon Jo, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 114 days.

(21) Appl. No.: 14/744,424

(22) Filed: Jun. 19, 2015

(65) Prior Publication Data

US 2016/0054047 A1 Feb. 25, 2016

(30) Foreign Application Priority Data

Aug. 21, 2014 (KR) ..... 10-2014-0108934

(51) Int. Cl.

*F25D 17/06* (2006.01)
*F25B 39/02* (2006.01)
*F25D 17/04* (2006.01)

(52) U.S. Cl.

CPC ..... *F25D 17/062* (2013.01); *F25B 39/024* (2013.01); *F25D 17/065* (2013.01); *F25D 17/067* (2013.01); *F25D 17/045* (2013.01); *F25D 2317/061* (2013.01); *F25D 2317/066* (2013.01); *F25D 2317/0671* (2013.01); *F25D 2317/0682* (2013.01);

(Continued)

(58) Field of Classification Search

CPC .... F25D 17/062; F25D 17/065; F25D 17/045; F25D 17/067; F25D 2317/061; F25D 2317/0684; F25D 2317/0682; F25D 2600/02; F25D 2700/121; F25D 2317/066; F25D 2317/0671; F25B 2600/112

See application file for complete search history.

(56) References Cited

U.S. PATENT DOCUMENTS 2,975,619 A 3/1961 Saunders
3,009,338 A * 11/1961 Dobbie ..... F25D 11/022 62/382

(Continued)

FOREIGN PATENT DOCUMENTS

DE 10 2011 075 946 A1 11/2012
EP 1 605 215 A2 12/2005

(Continued)

OTHER PUBLICATIONS

Machine Translation of KR 10-2010-0050350 A, Kim, May 2010.*

(Continued)

*Primary Examiner* — Frantz Jules
*Assistant Examiner* — Martha Tadesse
(74) *Attorney, Agent, or Firm* — Staas & Halsey LLP

(57) ABSTRACT

A refrigerator has a flow path structure formed by a heat-exchanger. The refrigerator includes storage compartments, and a cool air supplying unit provided at a rear of the storage compartments to supply cool air at the storage compartments, and the cool air supplying unit includes a heat-exchanger to divide a flow path at which cool air is provided to flow along the cool air supplying unit.

12 Claims, 23 Drawing Sheets

(52) U.S. Cl.
CPC .. *F25D 2317/0684* (2013.01); *F25D 2600/02* (2013.01); *F25D 2700/12* (2013.01); *F25D 2700/121* (2013.01)

(56) References Cited

U.S. PATENT DOCUMENTS

| | | | | | |
|---|---|---|---|---|---|
| 3,026,688 | A | | 3/1962 | O'Connell | |
| 3,077,749 | A | * | 2/1963 | Jung | F25D 17/065 312/236 |
| 3,169,383 | A | | 2/1965 | Morton et al. | |
| 2010/0275639 | A1 | * | 11/2010 | Jendrusch | F25D 17/065 62/407 |

FOREIGN PATENT DOCUMENTS

| | | | | | |
|---|---|---|---|---|---|
| EP | 1605215 | A2 | * | 12/2005 | F25D 17/045 |
| EP | 2 146 164 | A2 | | 1/2010 | |
| EP | 2146164 | A2 | * | 1/2010 | F25D 17/065 |
| EP | 2 224 194 | A2 | | 9/2010 | |
| KR | 10-2007-0094287 | | | 9/2007 | |
| KR | 20100050350 | A | * | 5/2010 | |
| KR | 10-2014-0009850 | | | 1/2014 | |
| WO | WO 2006/125643 | A1 | | 11/2006 | |
| WO | WO 2006125643 | A1 | * | 11/2006 | F25D 17/065 |

OTHER PUBLICATIONS

Extended European Search Report dated Jan. 1, 2016 in corresponding European Patent Application No. 15168703.5.
European Communication under Rule 71(3) EPC dated May 9, 2018 in European Patent Application No. 15168703.5.
Chinese Office Action dated Oct. 26, 2018 in Chinese Patent Application No. 201510404301.5.

* cited by examiner

REFRIGERATOR

CROSS-REFERENCE TO RELATED APPLICATIONS

This application claims the benefit of the Korean Patent Application No. 10-2014-0108934, filed on Aug. 21, 2014, in the Korean Intellectual Property Office, the disclosure of which is incorporated herein by reference.

BACKGROUND

1. Field

One or more embodiments relate to a refrigerator, and more particularly, a refrigerator having a flow path structure formed by a heat-exchanger.

2. Description of the Related Art

A refrigerator is a household appliance having a body, storage compartments formed at an inside the body to store foods, and a cool air supplying apparatus to supply cool air at the storage compartments so that the foods may be freshly stored.

The cool air supplying apparatus is generally provided with a compressor, a condenser, an expansion apparatus, and an evaporator, and as for the evaporator, a fin-tube type evaporator and a plate evaporator may be used.

Conventionally, the fin-tube type evaporator is used as means of supplying cool air to a temperature converting compartment.

The fin-tube type of an evaporating method is a method to supply cool air to the temperature converting compartment by a damper after the air at the evaporator and the temperature converting compartment is heat-exchanged, and difficulties in low efficiency as a result of low evaporation temperature and low efficiency as a result of loss from heat exchanges are present.

SUMMARY

One or more embodiments relate to a refrigerator having a plurality of flow paths formed by a heat-exchanger.

The foregoing described problems may be overcome and/or other aspects may be achieved by one or more embodiments of a refrigerator that may have a plurality of flow paths formed by a front surface and a rear surface of a roll-bond type evaporator as the roll-bond type evaporator may be disposed at a rear surface panel of the refrigerator while possibly being spaced apart from the rear surface panel.

The foregoing described problems may be overcome and/or other aspects may be achieved by one or more embodiments of a refrigerator that may be configured to adjust flow of cool air by a refrigerating compartment fan and a temperature converting compartment fan that may be installed at a flow path, or that may be configured to adjust flow of cool air by a damper that may be installed at one side of a refrigerating compartment or at one side of a temperature converting compartment.

Additional aspects and/or advantages of one or more embodiments will be set forth in part in the description which follows and, in part, will be obvious from the description, or may be learned by practice of one or more embodiments. One or more embodiments are inclusive of such additional aspects.

In accordance with one or more embodiments, a refrigerator may include a plurality of storage compartments, and a cool air supplying unit provided at a rear of the plurality of storage compartments to supply cool air at the plurality of storage compartments, and the cool air supplying unit may include a heat-exchanger to divide a flow path at which cool air is provided to flow along the cool air supplying unit.

In addition, the heat-exchanger may be capable of dividing a flow path of cool air provided to flow along the cool air supplying unit into a front flow path and a rear flow path.

In addition, the heat-exchanger may include an evaporator.

In addition, the evaporator may include a roll-bond type evaporator.

In addition, a fan configured to flow the cool air may be further included.

In addition, the fan may be capable of having the cool air flow so that the cool air may be supplied to at least one of the plurality of storage compartments.

In addition, the at least one of the plurality of storage compartments may include a temperature converting compartment, and the fan may include a temperature converting compartment fan provided at one side of the temperature converting compartment to adjust the flow of cool air being supplied at the temperature converting compartment.

In addition, the temperature converting compartment fan may be capable of supplying the cool air at the temperature converting compartment through the front flow path.

In addition, the fan may be provided at least at one of an upper side and a lower side of the heat-exchanger.

In addition, a rear cover at a rear of the plurality of storage compartments to divide the cool air supplying apparatus may be further included.

In addition, the fan may be provided at least at one of an upper side or a lower side of the rear cover.

In addition, a damper configured to communicate and shut off the flow of cool air flowing along the cool air supplying unit may be further included.

In addition, the damper may be formed at least at one side of the plurality of storage compartments.

In accordance with one or more embodiments, a refrigerator may include a body provided with a first storage compartment and a second storage compartment formed thereto, a cool air supplying unit provided at rear of the first storage compartment and the second storage compartment to supply cool air at the first storage compartment and the second storage compartment, a rear cover to divide the cool air supplying unit at a rear of the body, and a heat-exchanger disposed in between the body and the rear cover to divide a plurality of flow paths at the cool air supplying unit.

In addition, the heat-exchanger may be capable of dividing a flow path at which cool air is provided to flow along the cool air supplying unit into a front flow path and a rear flow path.

In addition, the heat-exchanger may include an evaporator.

In addition, the evaporator may include a roll-bond type evaporator.

In addition, a fan configured to flow the cool air and supply the cool air at least at one of the first storage compartment and the second storage compartment may be further included.

In addition, a damper configured to communicate and shut off the flow of cool air flowing along the cool air supplying unit may be further included.

With respect to a refrigerator and a controlling method thereof provided as described above, the following may be provided.

First, as a temperature converting compartment is implemented in a flow path structure formed by a heat-exchanger, the loss of heat occurred in the process of transporting cool air and the loss of cycle may be reduced, and thus energy conservation of a refrigerator may take place.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
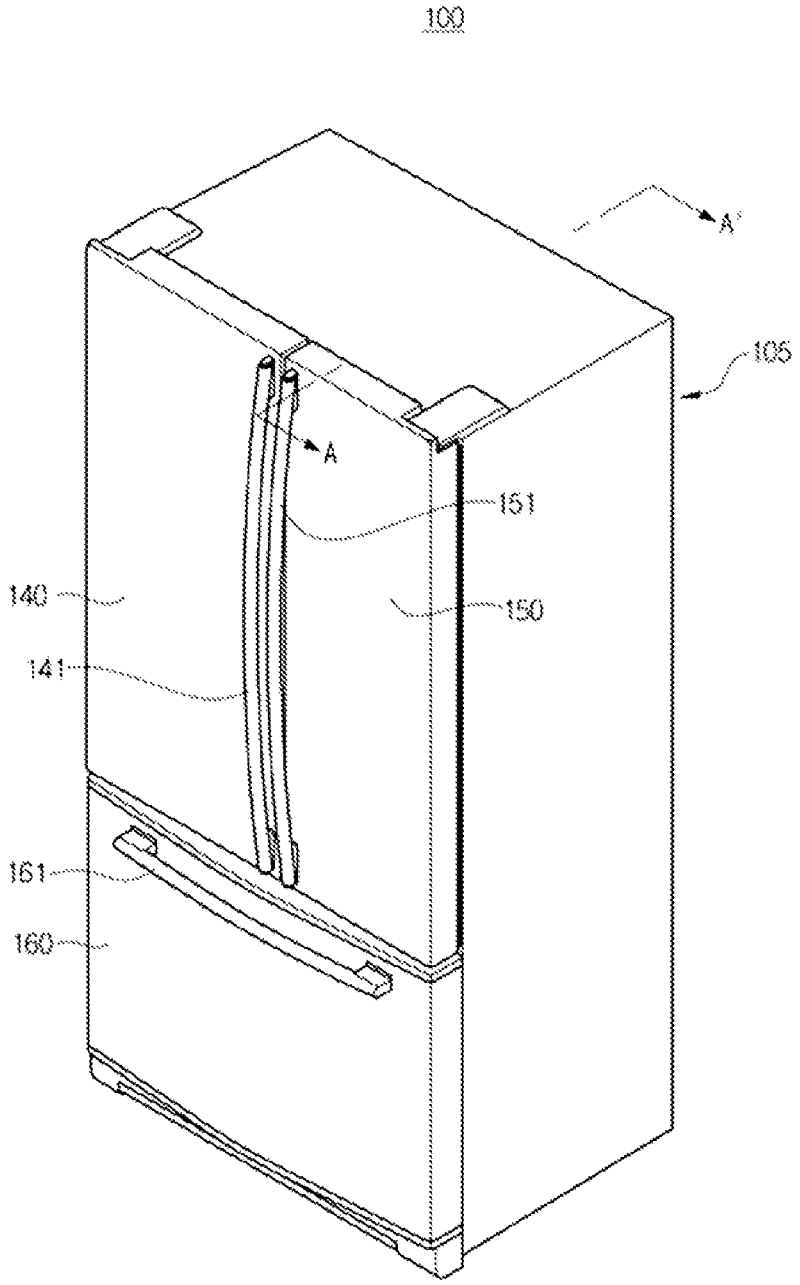
FIG. 1 is a perspective view illustrating an exterior appearance of a refrigerator in accordance with one or more embodiments.

Reference will now be made in detail to the embodiments of the present disclosure, examples of which are illustrated in the accompanying drawings, wherein like reference numerals refer to like elements throughout. In this regard, embodiments of the present invention may be embodied in many different forms and should not be construed as being limited to embodiments set forth herein. Accordingly, embodiments are merely described below, by referring to the figures, to explain aspects of the present invention.

Figure 2:
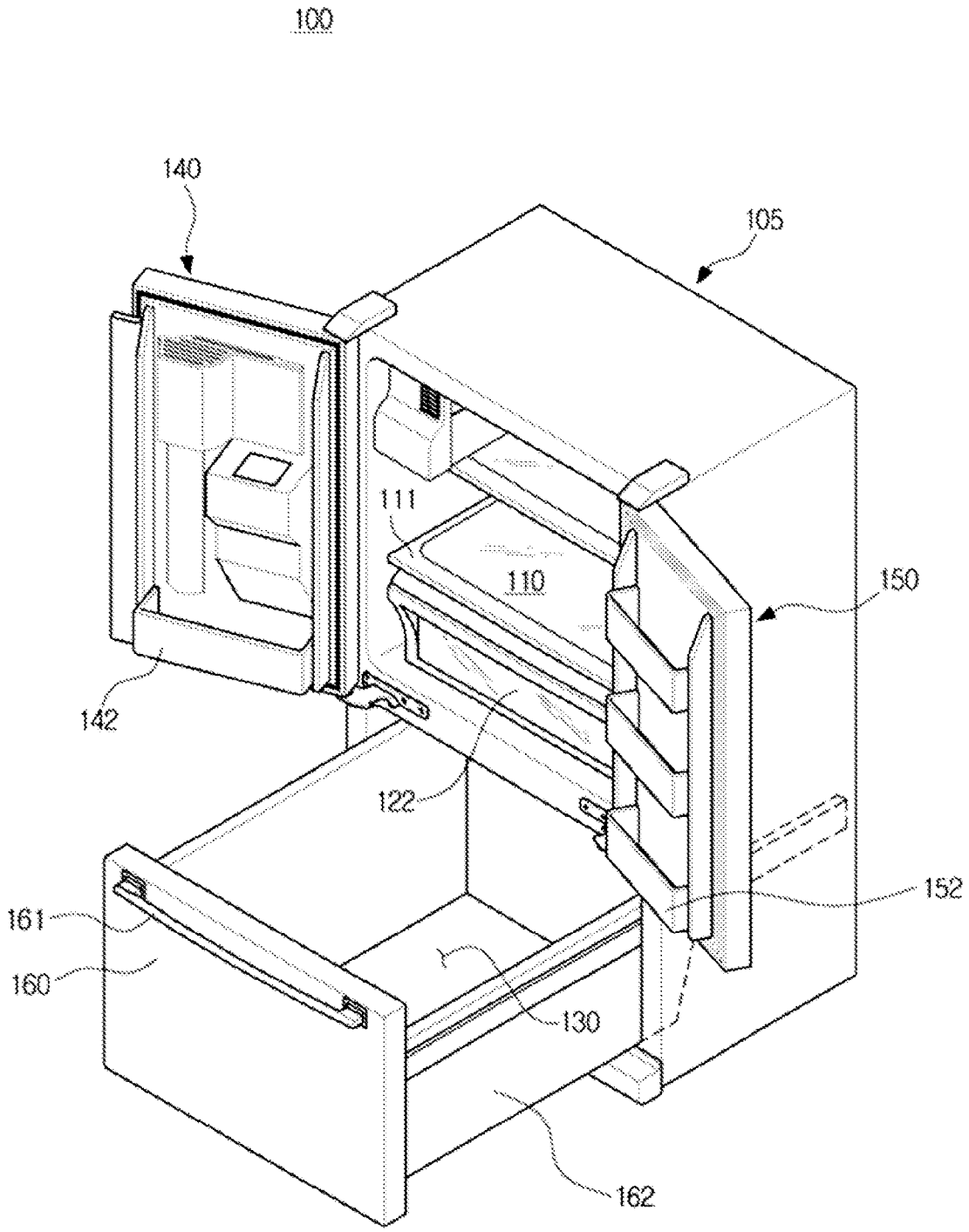
FIG. 2 is a drawing illustrating an inside of a refrigerator in accordance with one or more embodiments, such as the refrigerator of FIG. 1.
Figure 3:
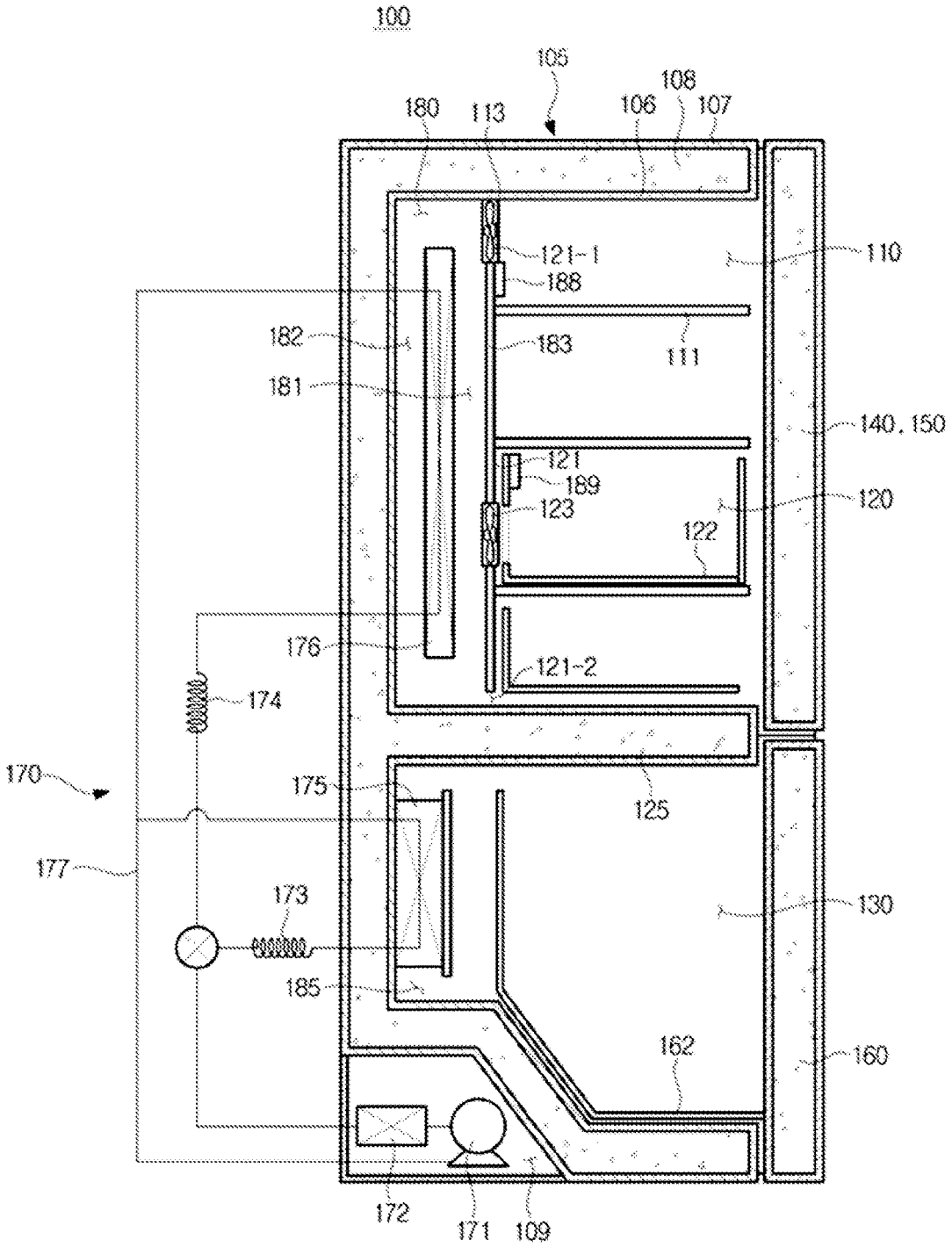
FIG. 3 is a cross-sectional view of a refrigerator in accordance with one or more embodiments, such as the refrigerator of FIG. 1 dissected in an AA' direction.

FIG. 1 is a perspective view illustrating an exterior appearance of a refrigerator 100 in accordance with one or more embodiments, FIG. 2 is a drawing illustrating an inside of a refrigerator in accordance with one or more embodiments, such as the refrigerator 100 of FIG. 1, and FIG. 3 is a cross-sectional view of a refrigerator in accordance with one or more embodiments, such as the refrigerator 100 of FIG. 1 dissected in an AA' direction.

Referring to FIG. 1 to FIG. 3, the refrigerator 100 may include a body 105 provided with a plurality of storage compartments 110, 120, and 130 formed thereto, storage compartment doors 140, 150, and 160 rotatably provided at a front surface of the body 105 and configured to close the plurality of storage compartments 110, 120, and 130 from an outside, and a cooling apparatus 170 to supply cool air to the plurality of storage compartments 110, 120, and 130.

The body 105 may be provided in the shape of a box, and may include an inside case 106 forming the plurality of storage compartments 110, 120, and 130, an outside case 107 coupled to an outside of the inside case 106 and configured to form an exterior appearance of the refrigerator 100, and an insulation material 108 filled in between the inside case 106 and the outside case 107 so as to prevent an outlet of the cool air from inside the plurality of storage compartments 110, 120, and 130 and configured to prevent an inlet of outside air into an inside the plurality of storage compartments 110, 120, and 130.

The inside case 106 may be formed, for example, by resin material through an injection molding, and the outside case 107 may be formed, for example, by steel plate material through a press processing. As for the insulation material 108, urethane foam may be used, for example.

The plurality of storage compartments 110, 120, and 130 may be divided into a refrigerating compartment 110 provided with a cooling function by a middle partition 125 and a freezing compartment 130 provided with a freezing function, and a lower end of the refrigerating compartment 110 may be divided into a temperature converting compartment 120.

The refrigerating compartment 110 may be maintained at a temperature of about 3° C., the temperature converting compartment 120 may be maintained at a temperature from about −5° C. to 1° C., and the freezing compartment 130 may maintained at a temperature of about −18° C.

In FIG. 1, FIG. 2 and FIG. 3, an example of a bottom-freeze type refrigerator is provided with the refrigerating compartment 110 formed at an upper side thereof and the freezing compartment 130 formed at a lower side thereof is illustrated, but is not limited hereto, and the side-by-side type refrigerator 100 provided with the refrigerating compartment 110 and the freezing compartment 130 formed at left and right sides thereof, the top-mount type refrigerator 100, or the refrigerator 100 having the features of the both of the side-by-side type refrigerator 100 and the top-mount type refrigerator 100 may also be used as example.

The refrigerating compartment 110 may be provided with a front surface thereof open as to store foods, and the open front surface may be open/closed by the pair of refrigerating compartment doors 140 and 150 rotatably coupled by hinge members. A shelf 111 on which food may be placed may be provided at in inside the refrigerating compartment 110, and a temperature sensor 188 to detect a temperature of an inside the refrigerating compartment 110 may be installed at one side of an inside the refrigerating compartment 110. Hereinafter, as to distinguish a temperature sensor of the temperature converting compartment 120, which is to be described later, with respect to the temperature sensor 118, the temperature sensor 118 installed at an inside the refrigerating compartment 110 is referred to as a first reference temperature sensor 188.

The temperature converting compartment 120 may be provided in the shape of a drawer, and may be divided at a lower end of the refrigerating compartment 110. The temperature converting compartment 120 may include an outside casing 121 having one surface thereof open while provided in the shape of a rectangle, and a drawer 122 provided to be withdrawn and detached from the outside casing 121 through the open one surface of the outside casing 121. With respect to the outside casing 121, the insulation material 108 may be filled as to insulate the temperature converting compartment 120 from cooling spaces such as the refrigerating compartment 110 and the freezing compartment 130 of the refrigerator 100.

The temperature converting compartment 120 may be used with an identical function as the refrigerating compartment 110 and the freezing compartment 130, but in general may used at a certain temperature that is different from the driving conditions of the refrigerating compartment 110 or the freezing compartment 130. The temperature converting compartment 120 may be preferred to be provided such that no temperature transfer takes place in between the temperature converting compartment 120 and the refrigerating compartment 110 and in between the temperature converting compartment 120 and the freezing compartment 130, so that the loss from heat exchanging may be minimized.

A temperature converting compartment fan 123 may be installed at a rear surface of the outside casing 121. The temperature converting compartment 120 may be used at a certain temperature that is different from the conditions of the refrigerating compartment 110 or the freezing compartment 130, and thus may be preferred to be provided with separate temperature controlling means. The refrigerator 100, in accordance with one or more embodiments, may be capable of adjusting the flow of cool air being supplied at the temperature converting compartment 120 by driving the temperature converting compartment fan 123.

The controlling of the temperature converting compartment 120 may be based on the value detected at a temperature sensor 189 that may be provided at the temperature converting compartment 120. Hereinafter, as to distinguish from the first reference temperature sensor 188 installed at the refrigerating compartment 110, the temperature sensor 189 provided at the temperature converting compartment 120 is referred to as a second reference temperature sensor 189.

Refrigerating compartment handles 141 and 151 configured to open/close the refrigerating compartment doors 140 and 150 may be provided at a front surface of the refrigerating compartment doors 140 and 150, and door guards 142 and 152 on which foods may be placed may be provided at lower surfaces of the storage compartment doors 140, 150, and 160. The refrigerating compartment doors 140 and 150 may be applied with an insulation structure so as to prevent an outlet of the cool air from inside the refrigerating compartment 110 to an outside and so as to prevent an inlet of the warm air from outside to an inside of the freezing compartment 130.

The freezing compartment 130 may be open/closed by the freezing compartment door 160 provided with a front surface thereof open as to store foods and possibly provided to be slidingly moved forward/backward. A freezing compartment door handle 161 configured to open/close the freezing compartment door 160 may be provided at a front surface of the freezing compartment door 160, and a storage box 162 may be provided at a lower surface.

The cool air supplying apparatus 170 may include a compressor 171 to compress a refrigerant, a condenser 172 to condense the refrigerant, capillary tubes 173 and 174 to expand the refrigerant, evaporators 175 and 176 to generate cool air by evaporating the refrigerant, and a refrigerant pipe 177 to guide the refrigerant.

The compressor 171 and the condenser 172 may be disposed at a machinery compartment 109 possibly provided at a lower portion of a rear of the body 105, and the evaporators 175 and 176 may be disposed at a cool air supplying unit 180 of the refrigerating compartment 110 provided at a lower portion of a rear of the body 105 and a cool air supplying unit 185 of the freezing compartment 130 provided at a rear of the freezing compartment 130, respectively. Therefore, the refrigerating compartment 110 and the freezing compartment 130 may be independently cooled.

In accordance with one or more embodiments, a rear cover 183 may be disposed at a rear surface of the refrigerating compartment 110 as to divide the cool air supplying unit 180 of the refrigerating compartment 110, and a heat-exchanger such as the evaporator 176 may be disposed at the cool air supplying unit 180 of the refrigerating compartment 110 as to divide the flow path of the cool air that flows along the cool air supplying unit 180 of the refrigerating compartment 110.

That is, the heat-exchanger may be disposed in between the rear surface of the refrigerating compartment 110 and the rear cover 183 to divide a plurality of flow paths at the cool air supplying unit 180 of the refrigerating compartment 110. Hereinafter, examples of the evaporator 176 of the refrigerating compartment 110 and the freezing compartment evaporator 175 will be described.

The plurality of flow paths may be divided into a front flow path 181 formed at a front surface of the evaporator 176 of the refrigerating compartment 110 and a rear flow path 182 formed at a rear surface of the refrigerating compartment evaporator 176, but is not limited hereto.

At least one inlet unit 121-1 and at least one outlet unit 121-2 may be formed at the rear cover 183, and a refrigerating compartment fan 113 may be installed at the inlet unit 121-1 to circulate cool air.

The inlet unit 121-1 may be formed at an upper portion of the rear cover 183 or at a lower portion of the rear cover 183. As illustrated on FIG. 3, in a case when the inlet unit 121-1 is formed at the upper portion of the rear cover 183, the outlet unit 121-2 may be formed at the lower portion of the rear cover 183, and the cool air may flow in a clockwise direction while passing through the front flow path 181 and the rear flow path 182.

In the contrary, in a case when the inlet unit 121-1 is formed at the lower portion of the rear cover 183, the outlet unit 121-2 may be formed at the upper portion of the rear cover 183, and the cool air may flow in a counter-clockwise direction while passing through the front flow path 181 and the rear flow path 182. The detailed descriptions of the above will be provided later.

As for the evaporators 175 and 176, a roll-bond type evaporator provided with a direct cooling method may be used. As the roll-bond type evaporator may be provided in the shape of a panel, the evaporator 176 may be disposed in between the rear surface of the refrigerating compartment 110 and the rear cover 183 so that the flow path of the cool air that flows along the cool air supplying unit 180 may be distinguished into the front flow path 181 and the rear flow path 182.

Figure 4:
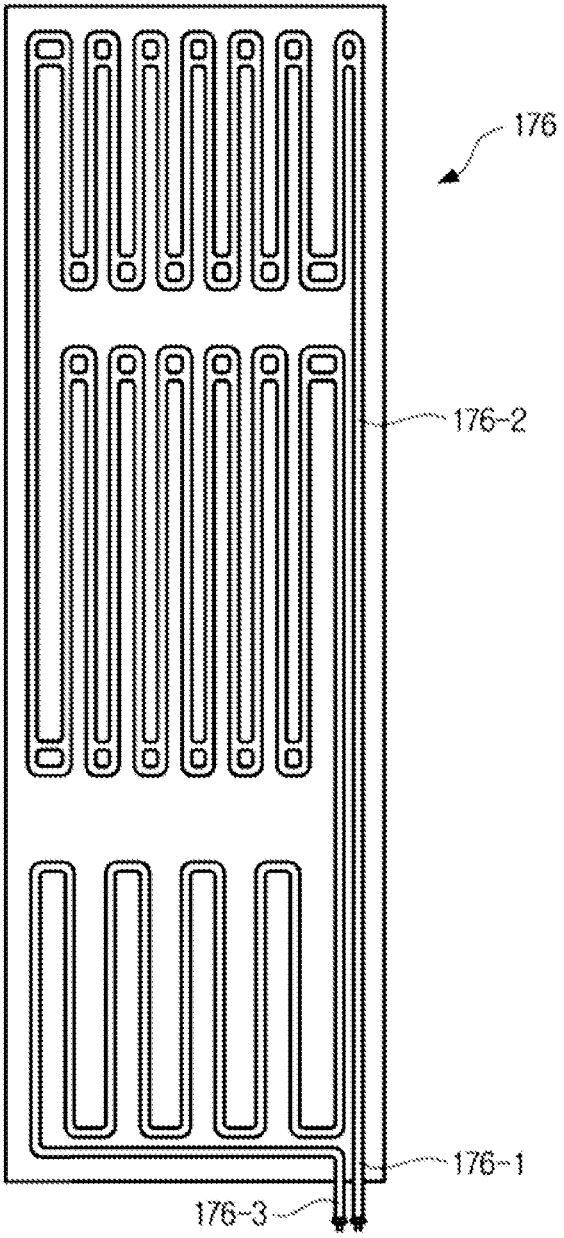
FIG. 4 is a drawing illustrating a roll-bond type evaporator in accordance with one or more embodiments.

FIG. 4 is a drawing illustrating a roll-bond type evaporator in accordance with one or more embodiments as an example of the refrigerating compartment evaporator 176.

Referring to FIG. 4, the refrigerating compartment evaporator 176 in accordance with one or more embodiments may be provided with an entry unit 176-1 through which a low-temperature, low-pressure refrigerant is inlet, as well as an exit unit 176-3 configured to supply the refrigerant circulated an inside to the compressor 171, and may include a refrigerant flow path 176-2 configured such that the refrigerant is circulated at the inside so as to perform a heat exchange while being exposed at the cool air supplying unit 180 of the refrigerating compartment 110.

The refrigerating compartment evaporator 176 may be designed to be provided with the shape of a plane panel. The refrigerant that may be inlet through the entry unit 176-1 of the refrigerating compartment evaporator 176 may exit through the exit unit 176-3 after passing through the refrigerant flow path 176-2 having various shapes at an inside and provided with a flow path having a length greater than certain length.

The refrigerant flow path 176-2 of the refrigerating compartment evaporator 176 is generally formed with a long length so as to perform further efficient heat exchange, and even with respect to the illustrated embodiment, the refrigerant flow path 176-2 may be provided with the shape that is bent several times in vertical direction.

Figure 5:
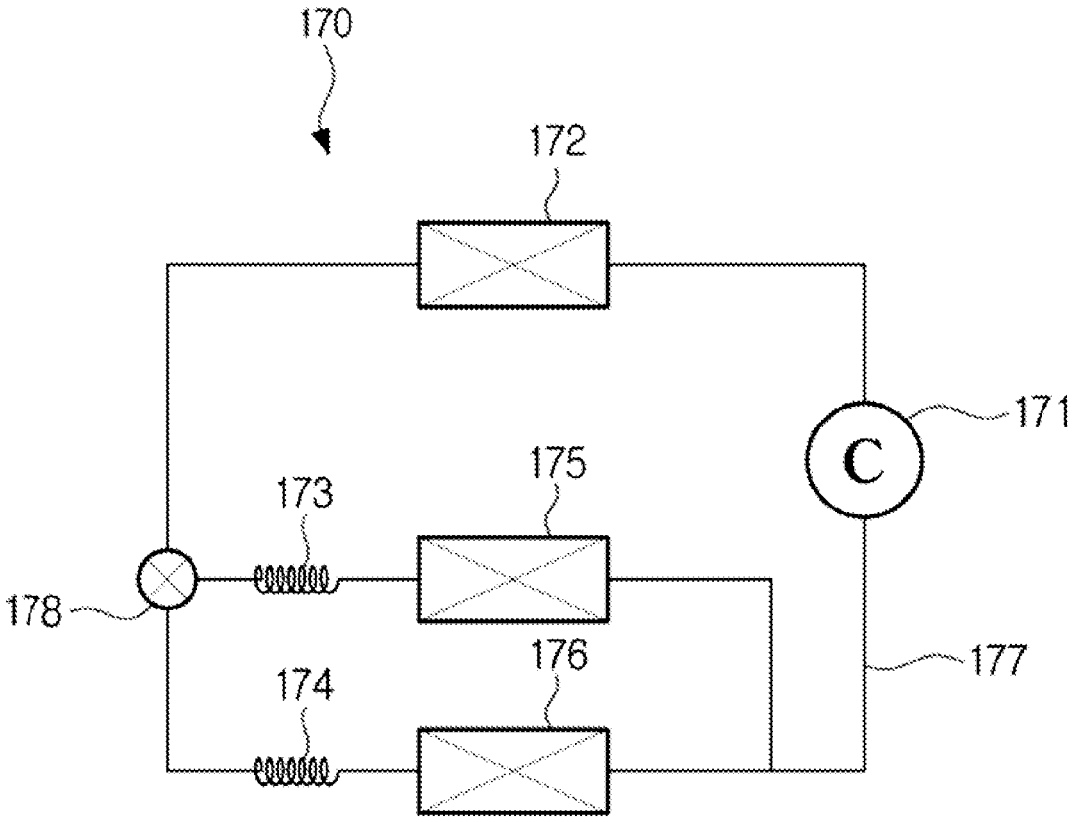
FIG. 5 is a drawing illustrating a flow of a refrigerant of a refrigerator in accordance with one or more embodiments.

FIG. 5 is a drawing illustrating a flow of a refrigerant in a refrigerator according to one or more embodiments, such as the refrigerator in accordance with one embodiment of the present disclosure.

The cool air supplying apparatus 170 may include the compressor 171, the condenser 172, the capillary tubes 173 and 174, the evaporators 175 and 176, and the refrigerant pipe 177, as described above.

The compressor 171 may be installed at the machinery compartment 109 possibly provided at the lower portion of the body 105, and may be configured to compress a refrigerant at high temperature and high pressure by the rotational force of an electric motor while supplied with an electricity from an outside.

The refrigerant compressed at high temperature and high pressure may be condensed while passing through the condenser 172 possibly provided at the rear of the body 105. A condenser fan may be disposed at one side of the condenser 172 as to expedite a condensation of the compressed refrigerant.

The condensed refrigerant may be moved to the evaporators 175 and 176 that may be positioned at the each different storage compartments 110 and 130, as the flow path is selectively converted by a flow path adjusting valve 178.

The flow path adjusting valve 178 may be provided to be driven by an electrical force, and may be provided to be driven by solenoid or a motor, for example.

The condensed refrigerant may be moved to the evaporators 175 and 176, as the condensed refrigerant is converted into a low-temperature, low-pressure liquid state while passing through the capillary tubes 173 and 174. The evaporators 175 and 176 may be provided to generate cool air as the surrounding air is cooled while the low-temperature, low-pressure refrigerant in a liquid state, which may be passed through the capillary tubes 173 and 174, is possibly evaporated by the evaporators 175 and 176.

The refrigerant that may be completely evaporated may be supplied again to the compressor 171 so that a cooling cycle may be repeated. Although not illustrated, a defrost heater configured to remove the frost, which may be placed at the evaporators 175 and 176 during a process of generating cool air, by heat may be provided at the evaporators 175 and 176.

Figure 6:
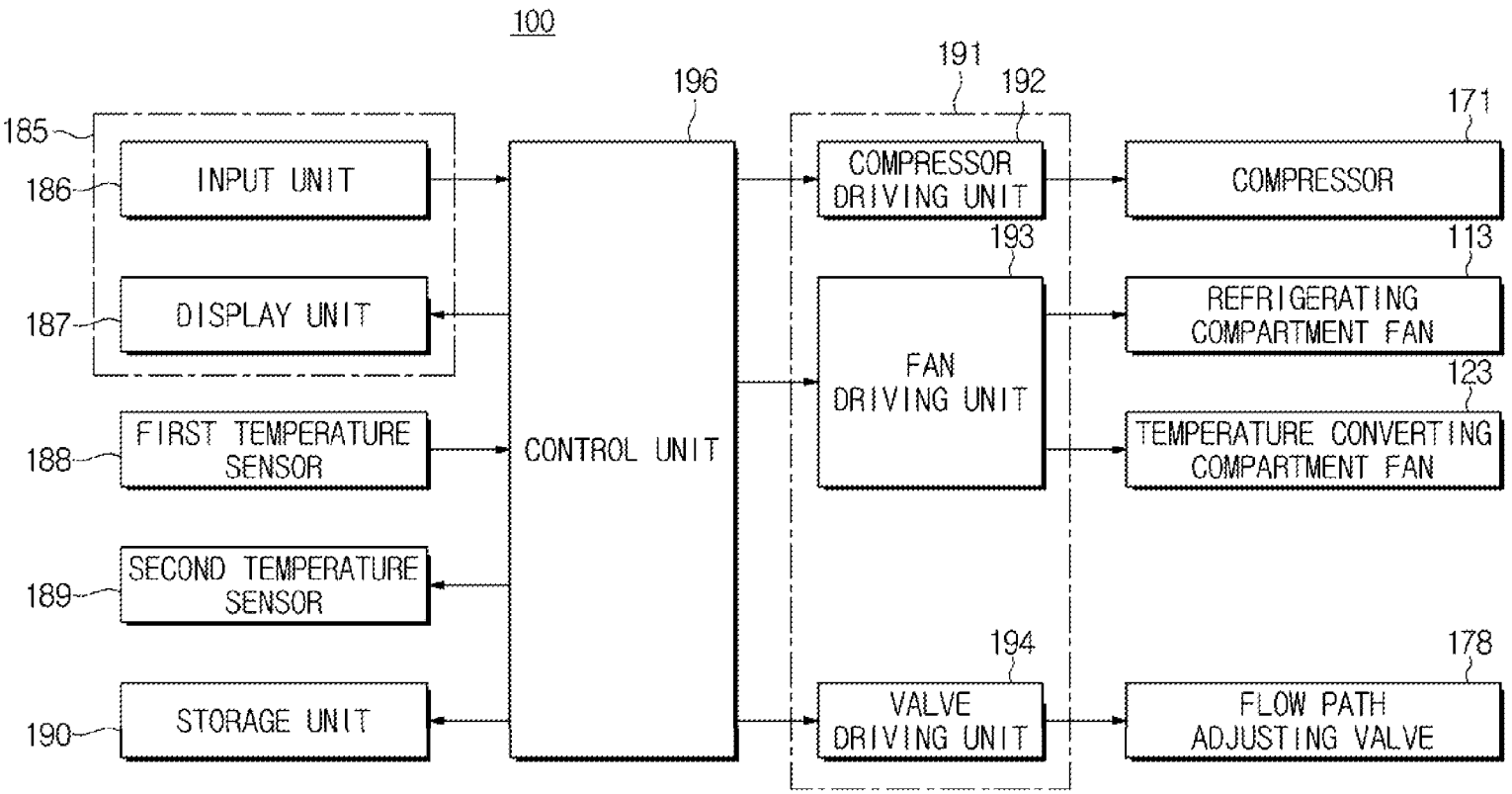
FIG. 6 is a drawing illustrating a block diagram of a refrigerator in accordance with one or more embodiments.

FIG. 6 is a drawing illustrating a control block diagram of a refrigerator in accordance with one or more embodiments.

Referring to FIG. 6, the refrigerator 100 may include a control panel 185, the first temperature sensor 188 to detect a temperature of the refrigerating compartment 110, the second temperature sensor 189 to detect a temperature of the temperature converting compartment 120, a storage unit 190, a driver such as the driving unit 191 to drive the compressor 171, the temperature converting compartment fan 123, the refrigerating compartment fan 113, and the condenser fan, and a controller such as the control unit 196 to control a driving of the compressor 171, the temperature converting compartment fan 123, and the refrigerating compartment fan 113.

The control panel 185 may include an input unit 186 to receive an input of operation commands of the refrigerator 100 from a user, and a display unit 187 to display a status or driving information of the refrigerator 100 to a user.

The input unit 186 may employ, for example, a press-type switch or a touchpad or the like, and the display unit 187 may employ, for example, a Liquid Crystal Display (LCD) panel or a Light Emitting Diode (LED) panel or the like.

The input unit 186 and the display unit 187 may be separately provided or may be integrally provided such as through a Touch Screen Panel (TSP) or the like.

The first temperature sensor 188 may be installed inside the refrigerating compartment 110, and the second temperature sensor 189 may be installed inside the temperature converting compartment 120, and may be provided to detect the temperatures of the refrigerating compartment 110 and the temperature converting compartment 120, respectively. The first and the second temperature sensors 188 and 189 may detect the temperatures of the refrigerating compartment 110 and the temperature converting compartment 120, respectively, at predetermined time intervals.

The temperatures that may be detected by the first and the second temperature sensors 188 and 189 each may be delivered to the control unit 196, and the control unit 196 may be provided to control the driving of the compressor 171, the refrigerating compartment fan 113, and the temperature converting compartment fan 123 on the basis of the temperature data collected from the first and the second temperature sensors 188 and 189.

The first and the second temperature sensors 188 and 189 may be implemented, for example, in the form of contact-type temperature sensors, or in the form of non-contact type temperature sensors, or the like. In detail, the temperature sensor may be implemented, for example, in the form of a RTD (Resistance Temperature Detector) temperature sensor configured to use resistance change of metallic material according to temperature change, a thermistor temperature sensor configured to use resistance change of semiconductor according to temperature change, a thermocouple temperature sensor configured to use electromotive force generated at both ends of points of contacts of two types of metallic wires provided with different materials with respect to each other, and an IC temperature sensor configured to use voltages of both ends of a transistor or current-voltage characteristics of a P-N contacting unit, both are provided to be changed according to temperature. However, the above is not limited hereto, and any possible means may be employed as to detect temperatures.

The storage unit 190 may store various data, programs, or applications to drive and control the refrigerator 100. For example, the storage unit 190 may store the data with respect to detection intervals of the first and second temperature sensors 188 and 189, driving time of the compressor 181 according to the detection results of the first and second temperature sensors 188 and 189, or driving RPM, and may also store control programs to control the refrigerator 100, exclusive applications initially provided from manufacturers, or programs such as general-purpose applications downloaded from outside.

The storage unit 190 may be implemented, for example, in the form of a non-volatile memory terminal such as a Read Only Memory (ROM), a Programmable Read Only Memory (ROM), an Erasable Programmed Read Only Memory (EPRM), or a flash memory, a volatile memory such as a Random Access Memory; RAM), or a storage apparatus such as a hard disk, or an optical disc, and is not limited hereto.

The driving unit 191 may be configured to output driving signals to each component of the refrigerator 100. The driving unit 191 may include a compressor driver such as the compressor driving unit 192 to drive the compressor 171, a fan driver such as the fan driving unit 193 to drive the temperature converting compartment fan 123 and the refrigerating compartment fan 113, and a valve driver such as the valve driving unit 194 to drive the flow path adjusting valve 178.

The control unit 196 may be configured to control signal flows in between the inside component elements of the refrigerator 100 as well as general operations of the refrigerator 100, and process data. The control unit 196 may execute an OS (Operating System) and various applications stored at the storage unit 190, in a case when an input of a user is made or predetermined conditions are satisfied.

The control unit 196 may control the compressor 171, the refrigerating compartment fan 113, and the temperature converting compartment fan 123 if it is determined that a temperature setting command of the refrigerator 100 is input or if it is determined that the temperature of the refrigerating compartment 110 or the temperature converting compartment 120 is higher than a predetermined reference temperature as a result of the detection of the first and second temperature sensors 188 and 189.

In more detail, the control unit 196 may control components of the refrigerator such that cool air is simultaneously supplied at the refrigerating compartment 110 and the temperature converting compartment 120 according to a prestored program, or may control the temperature of the temperature converting compartment 120 after controlling the temperature of the refrigerating compartment 110 by supplying cool air at the refrigerating compartment 110.

Hereinabove, the descriptions are provided with respect to the each component of the refrigerator 100 in accordance with one or more embodiments. Hereinafter, the controlling process of a refrigerator according to one or more embodiments, such as the refrigerator 100 according to FIG. 1 to FIG. 3 will be described.

Figure 7:
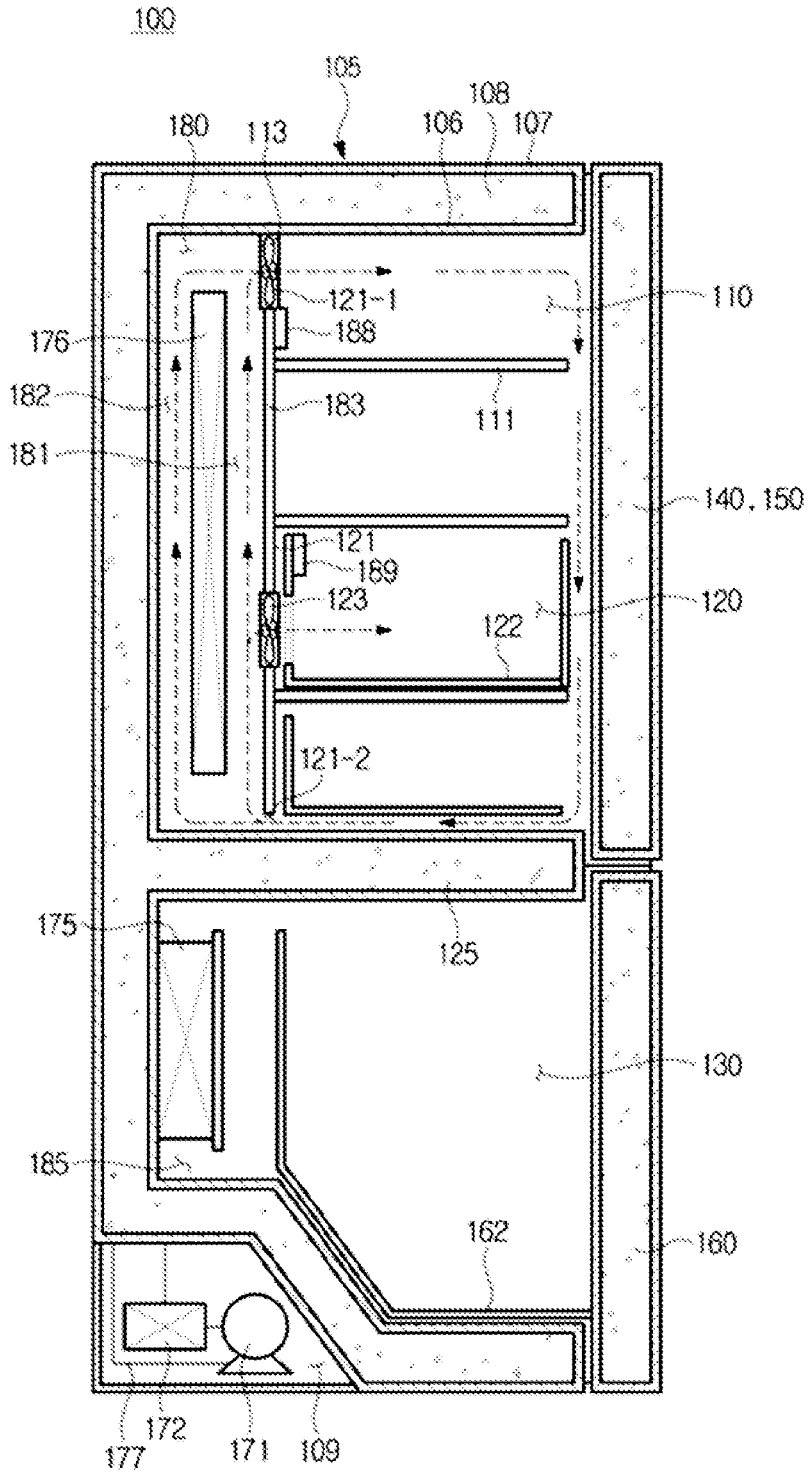
FIG. 7 and FIG. 8 are drawings illustrating a cool air supplying process of a refrigerator in accordance with one or more embodiments.
Figure 8:
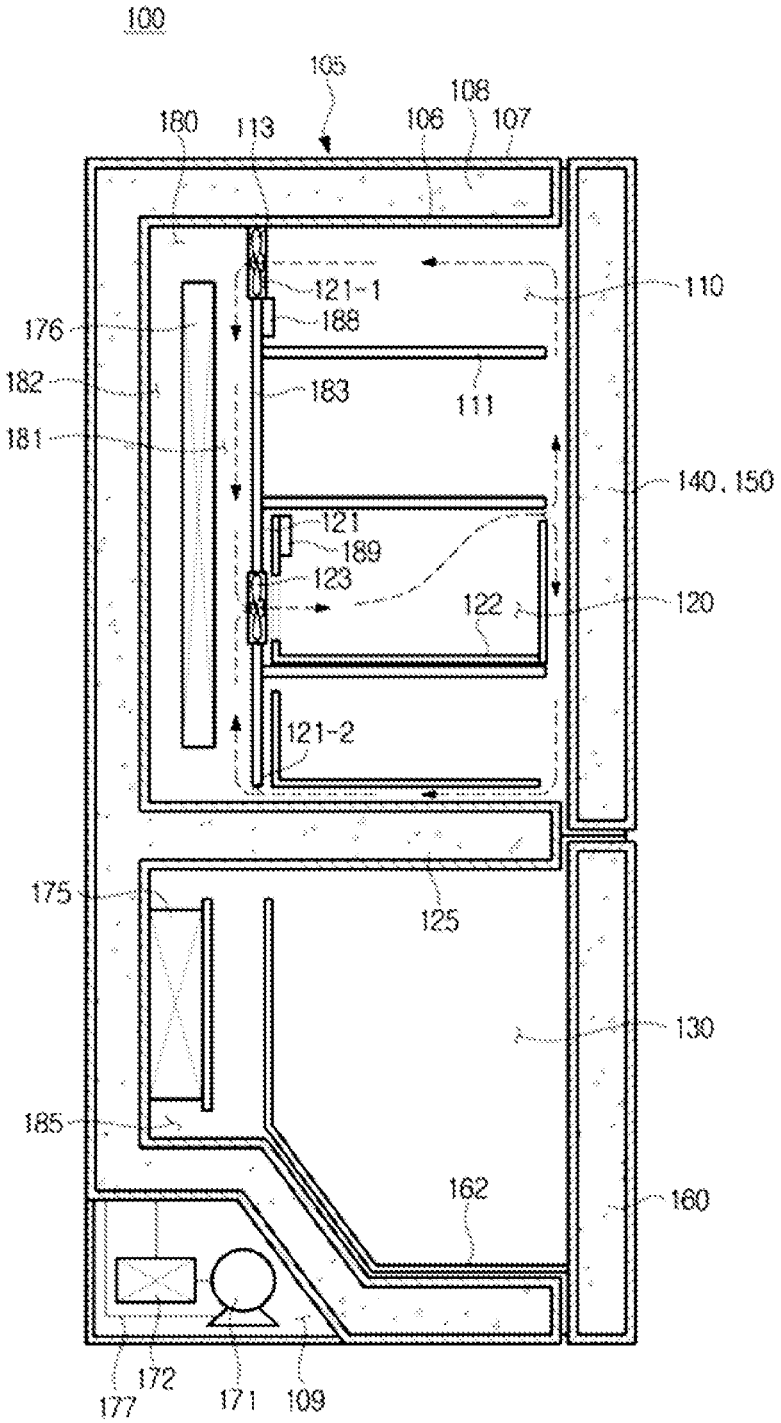
Figure 9:
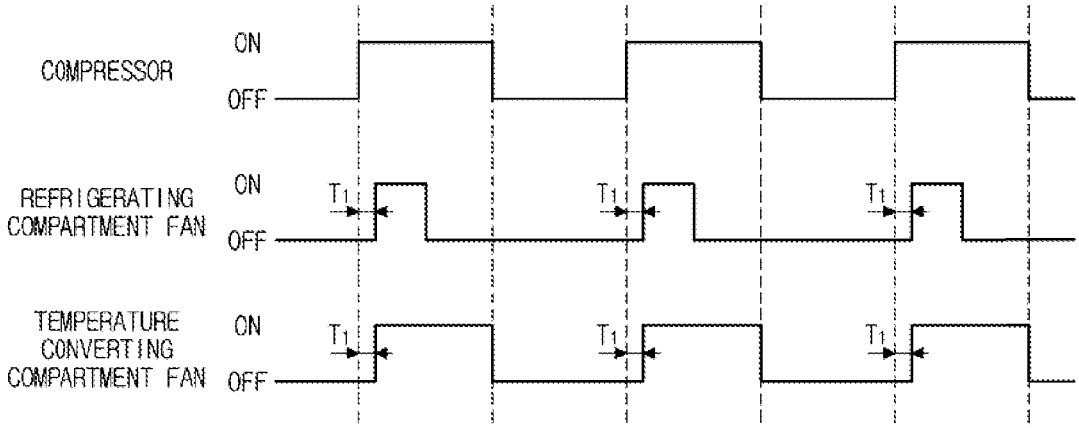
FIG. 9 is a graph showing operations of a refrigerator in accordance with one or more embodiments, such as the refrigerator according to FIG. 7 and FIG. 8.

FIG. 7 and FIG. 8 are drawings illustrating a cool air supplying process of a refrigerator in accordance with one or more embodiments, and FIG. 9 is a graph showing operations of a refrigerator according to one or more embodiments, such as the refrigerator according to FIG. 7 and FIG. 8. Hereinafter, the cool air supplying process of the refrigerator 100 will be described by the refrigerator 100 according to FIG. 1 to FIG. 3 as an example.

The controlling process of the refrigerator 100 in accordance with one or more embodiments, after simultaneously supplying cool air at the refrigerating compartment 110 and the temperature converting compartment 120, may include a stopping of a driving of the refrigerating compartment fan 113 when it is determined that the temperature of the refrigerating compartment 110 has reached a predetermined reference temperature, and a supplying of the cool air at the temperature converting compartment 120 by continuously driving the temperature converting compartment fan 123.

In more detail, the first and second temperature sensors 188 and 189 may be provided to detect temperatures of the refrigerating compartment 110 and the temperature converting compartment 120 at a regular interval.

If it is determined that the temperature of the refrigerating compartment 110 is higher than a first reference temperature and that the temperature of the temperature converting compartment 120 is higher than a second reference temperature as a result of the detection, the compressor 171, the refrigerating compartment fan 113, and the temperature converting compartment fan 123 may be driven.

In the controlling process in accordance with one or more embodiments, when a first time T1 is elapsed after the compressor 171 is driven, the refrigerating compartment fan 113 and the temperature converting compartment fan 123 may be driven. As the above, by driving the refrigerating compartment fan 113 and the temperature converting compartment fan 123 after cool air is generated in some degree, cooling efficiency may be improved.

The refrigerating compartment fan 113 may be disposed at the upper portion of the rear cover 183, and thus when the refrigerating compartment fan 113 is driven, as illustrated on FIG. 7, a flow of cool air, which may flow in a clockwise direction while passing through the front flow path 181 and the rear flow path 182, may be generated. In the embodiment of the present disclosure, since the temperature converting compartment fan 123 may be simultaneously driven, a portion of the cool air that flows from a lower side to an upper side after passing through the front flow path 181 may be supplied at the temperature converting compartment 120.

The temperature of the temperature converting compartment 120 may be set to be lower than the temperature of the refrigerating compartment 110. That is, the first reference temperature may be set to be higher than the second reference temperature. For example, the first reference temperature may be set at about 5° C. and the second reference temperature may be set at in the range of about −2° C. and about 5° C.

According to the above, the temperature of the refrigerating compartment 110 may be reached earlier at the first reference temperature.

If it is determined that the temperature of the refrigerating compartment 110 is reached at the first reference temperature, the operation of the refrigerating compartment fan 113 may be stopped, and the compressor 171 and the temperature converting compartment fan 123 may be continuously driven only.

At this time, the temperature converting compartment fan 123 may be rotated at a further higher RPM than before, and in such a case, the temperature of the temperature converting compartment 120 may be reached at the second reference temperature faster.

As illustrated on FIG. 8, when the refrigerating compartment fan 113 is stopped and the temperature converting compartment fan 123 is driven at further higher RPM, a flow of cool air flowing from the front flow path 181 to an inside the temperature converting compartment 120 may be generated.

If it is determined that the temperature of the temperature converting compartment 120 is reached at the second reference temperature, the operations of the compressor 171 and the temperature converting compartment fan 123 may be stopped.

The ON/OFF controlling process of the compressor 171, the refrigerating compartment fan 113, and the temperature converting compartment fan 123 is illustrated on FIG. 9.

When the first time T1 is elapsed after the compressor 171 is driven, the refrigerating compartment fan 113 and the temperature converting compartment fan 123 may be driven. After the above, when the temperature of the refrigerating compartment 110 is reached at the first reference temperature, the refrigerating compartment fan 113 may be converted into an OFF status, and the temperature converting compartment fan 123 is continuously driven. Then, when the temperature of the temperature converting compartment 120 is reached at the second reference temperature, the temperature converting compartment fan 123 may be converted into an OFF status as well.

The process above is performed repeatedly, and cool air is supplied at the refrigerating compartment 110 and the temperature converting compartment 120.

Figure 10:
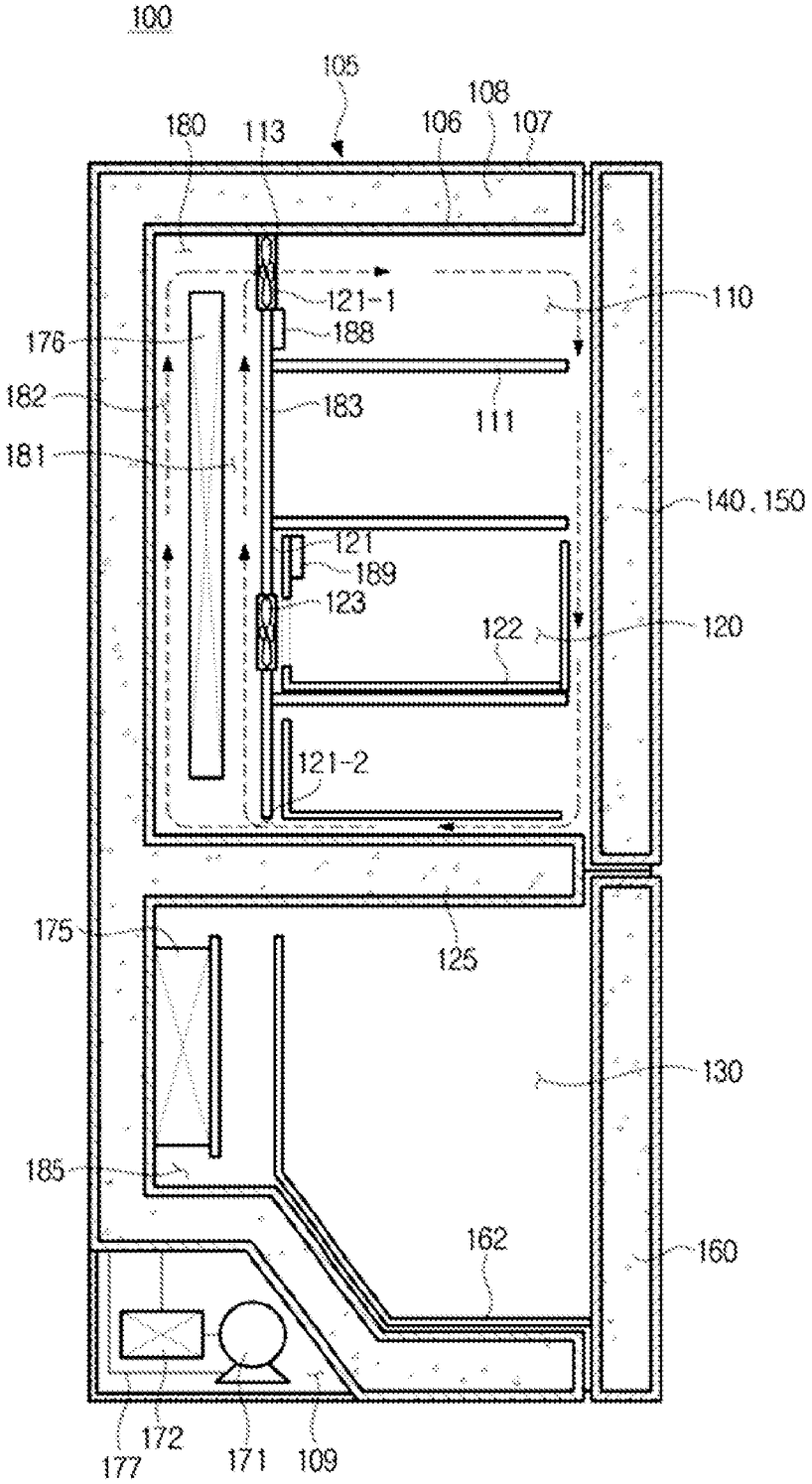
FIG. 10 and FIG. 11 are drawings illustrating a cool air supplying process of a refrigerator in accordance with one or more embodiments.
Figure 11:
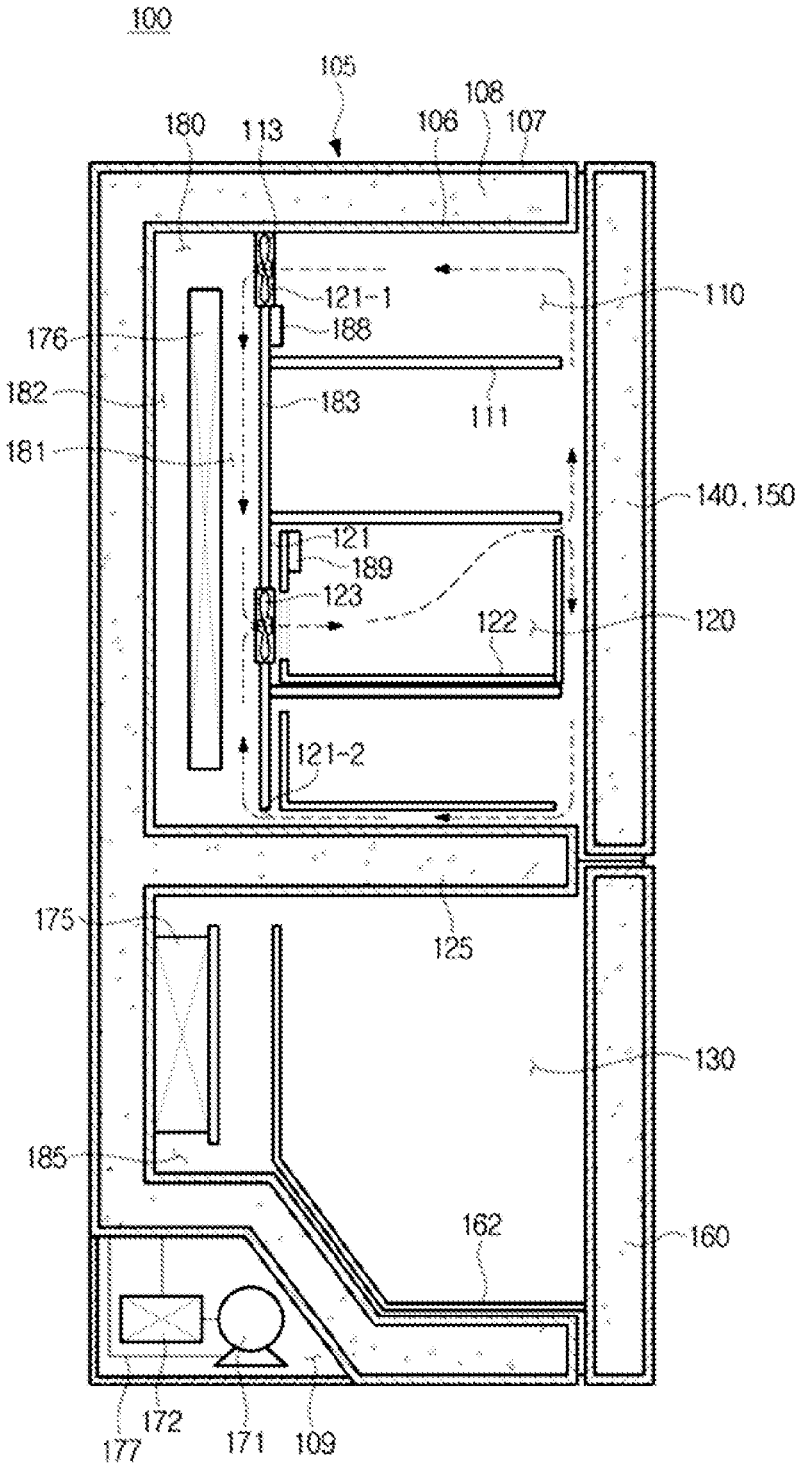
Figure 12:
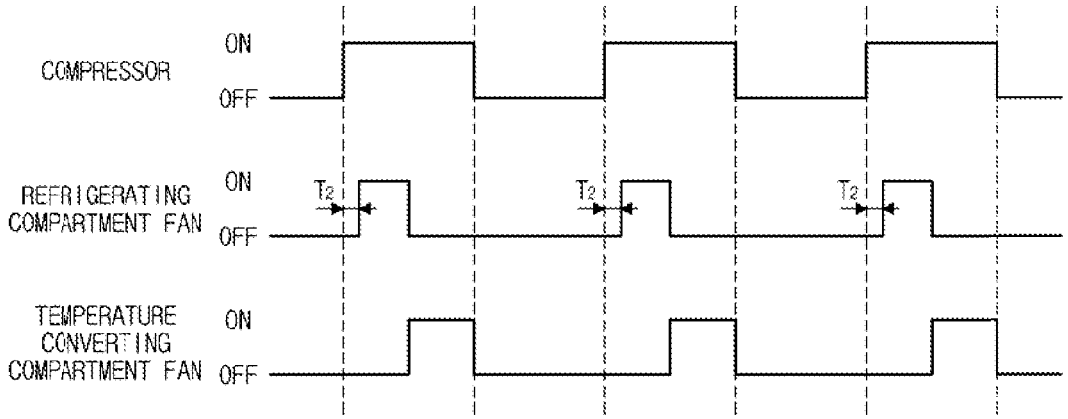
FIG. 12 is a graph showing operations of a refrigerator in accordance with one or more embodiments, such as the refrigerator according to FIG. 10 and FIG. 11.

FIG. 10 and FIG. 11 are drawings illustrating a cool air supplying process of a refrigerator in accordance with one or more embodiments, and FIG. 12 is a graph showing operations of a refrigerator according to one or more embodiments, such as the refrigerator according to FIG. 10 and FIG. 11. Hereinafter, the cool air supplying process of the refrigerator 100 will be described by using the refrigerator 100 in accordance with FIG. 1 to FIG. 3 as an example.

The controlling process of the refrigerator 100 in accordance with one or more embodiments may include a supplying of cool air at the refrigerating compartment 110 by driving the compressor 171 and the refrigerating compartment fan 113, a stopping of a driving of the refrigerating compartment fan 113 if determined that the temperature of the refrigerating compartment 110 is reached at the predetermined first reference temperature, and a supplying of cool air at the temperature converting compartment 120 by driving the temperature converting compartment fan 123.

In more detail, the first and second temperature sensors 188 and 189 may be provided to detect the temperatures of the refrigerating compartment 110 and the temperature converting compartment 120 at a regular interval.

If it is determined that the temperature of the refrigerating compartment 110 is higher than the first reference temperature and that the temperature of the temperature converting compartment 120 is higher than the second reference temperature after a result of the detection, the compressor 171 and the refrigerating compartment fan 113 may be driven.

When a second time T2 is elapsed after the compressor 171 is driven, the refrigerating compartment fan 113 may be driven. As the above, by driving the refrigerating compartment fan 113 after cool air is generated in some degree, cooling efficiency may be improved.

The refrigerating compartment fan 113 may be disposed at the upper portion of the rear cover 183, and thus when the refrigerating compartment fan 113 is driven, as illustrated on FIG. 10, a flow of cool air, which may flow in a clockwise direction while passing through the front flow path 181 and the rear flow path 182, may be generated.

In one or more embodiments, since the controlling of the temperature converting compartment 120 is performed after controlling the refrigerating compartment 110, the temperature converting compartment fan 123 is not driven. As the above, the cool air generated at the refrigerating compartment evaporator 176 may flow after passing through the cool air supplying unit 180 and the refrigerating compartment 110.

When the temperature of the refrigerating compartment 110 is reached at the first reference temperature, the operation of the refrigerating compartment fan 113 may be turned OFF, and the temperature converting compartment fan 123 may be driven.

When the temperature converting compartment fan 123 is driven, a flow of cool air flowing from the front flow path 181 to an inside the temperature converting compartment 120 may be generated, and if it is determined that the temperature of the temperature converting compartment 120 is reached at the second reference temperature, the operations of the compressor 171 and the temperature converting compartment fan 123 may be stopped.

The ON/OFF controlling process of the compressor 171, the refrigerating compartment fan 113, and the temperature converting compartment fan 123 is illustrated on FIG. 12.

When the second time T2 is elapsed after the compressor 171 is driven, the refrigerating compartment fan 113 may be driven. After the above, when the temperature of the refrigerating compartment 110 is reached at the first reference temperature, the refrigerating compartment fan 113 may be converted into an OFF status, and the temperature converting compartment fan 123 may be started to be driven. Then, when the temperature of the temperature converting compartment 120 is reached at the second reference temperature, the temperature converting compartment fan 123 may be converted into an OFF status as well. The process above may be performed repeatedly, and cool air may be supplied at the refrigerating compartment 110 and the temperature converting compartment 120.

Figure 13:
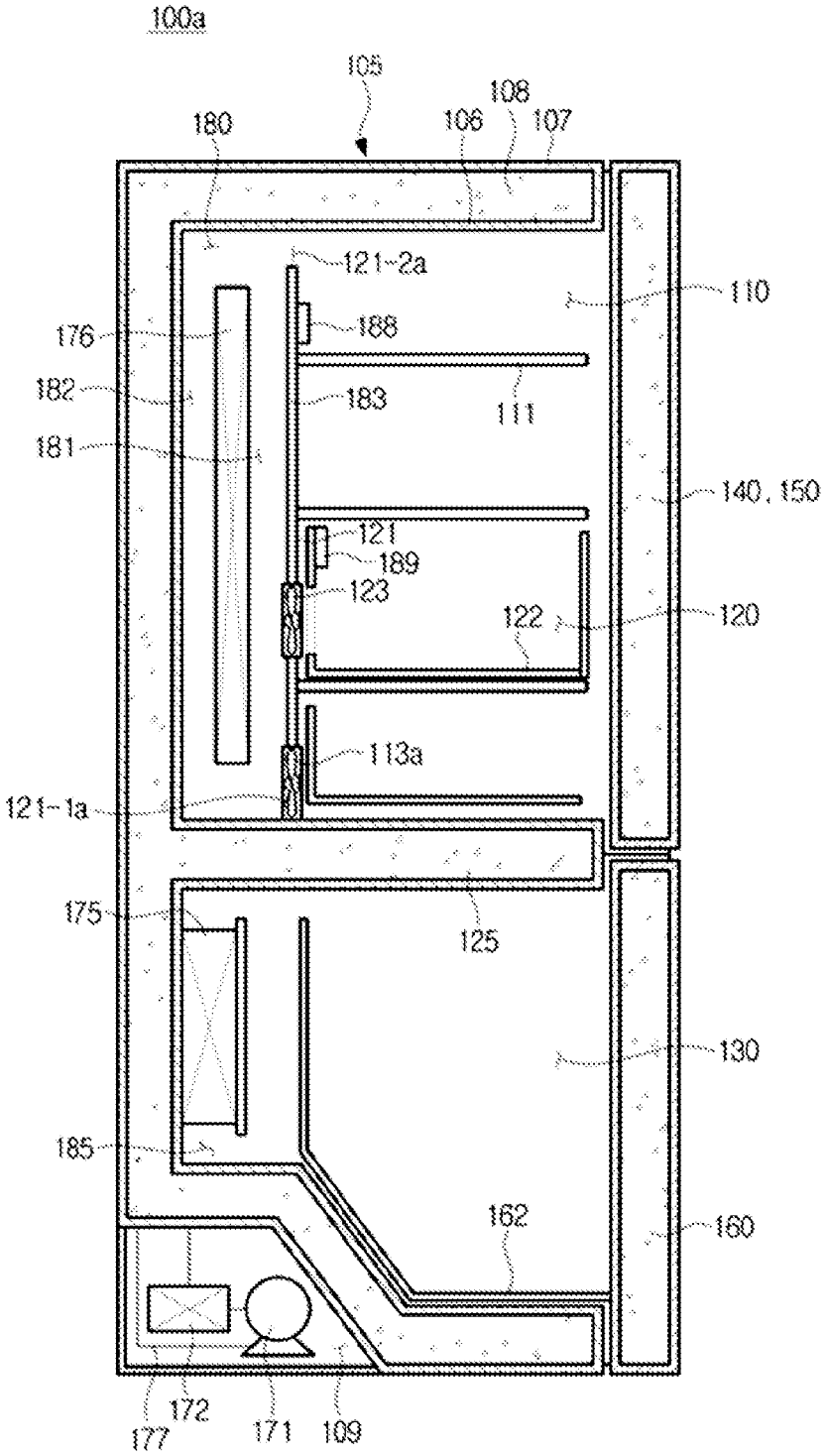
FIG. 13 is a drawing illustrating a cross-sectional view of a refrigerator in accordance with one or more embodiments.

FIG. 13 is a drawing illustrating a cross-sectional view of the refrigerator 100*a* in accordance with one or more embodiments.

Referring to FIG. 13, the refrigerator 100*a* may include a body 105 provided with the plurality of storage compartments 110, 120, and 130 formed thereto, and the cooling apparatus 170 to supply cool air to the plurality of storage compartments 110, 120, and 130. The structure of the body 105 and the cooling apparatus 170 are identical with respect to FIG. 1 to FIG. 3, and the overlapping descriptions hereinafter will be omitted.

The refrigerator 100*a* according to FIG. 13 may be provided with a refrigerating compartment fan 113*a* installed at a lower portion of the cover 183 dividing the cool air supplying unit 180 of the refrigerating compartment 110, and thus is different when compared to the refrigerator 100 from FIG. 1 to FIG. 3. The refrigerator 100*a* in accordance with one or more embodiments may be provided with an inlet unit 121-1*a* at a lower portion of the rear cover 183, and the refrigerating compartment fan 113*a* may be installed at the inlet unit 121-1*a*. The installation position of the refrigerating compartment fan 113*a* is not limited hereto, and the refrigerating compartment fan 113*a* may be installed at the inlet unit 121-1*a* of the rear cover 183 and at an outlet unit 121-2*a* to adjust the flow of cool air.

As the refrigerating compartment fan 113*a* may be installed at the inlet unit 121-1*a* formed at the lower portion of the rear cover 183, and when the refrigerating compartment fan 113 is driven, cool air may flow in a counterclockwise direction while passing through the front flow path 181 and the rear flow path 182 formed at the cool air supplying unit 180 of the refrigerating compartment 110.

The refrigerator 100*a* in accordance with one or more embodiments as well may simultaneously control the temperatures of the refrigerating compartment 110 and the temperature converting compartment 120, or may control the temperature of the temperature converting compartment 120 after controlling the temperature of the refrigerating compartment 110, and the controlling process of temperature of the refrigerating compartment 110 and the temperature converting compartment 120 is identical with respect to FIG. 7 to FIG. 12, and thus the overlapping descriptions will be omitted hereinafter.

Figure 14:
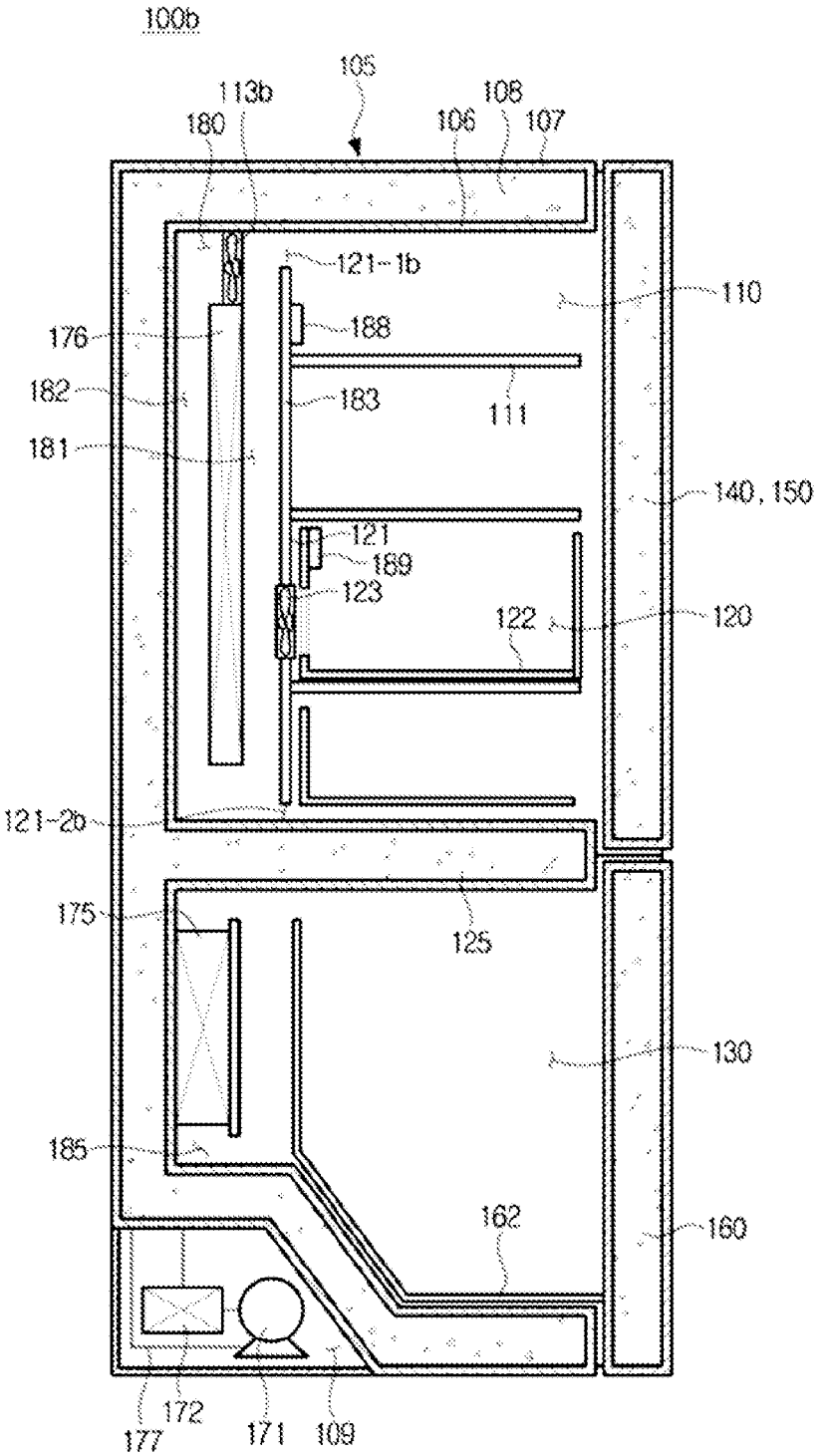
FIG. 14 is a drawing illustrating a cross-sectional view of a refrigerator in accordance with one or more embodiments.

FIG. 14 is a drawing illustrating a cross-sectional view of a refrigerator 100*b* in accordance with one or more embodiments.

Referring to FIG. 14, the refrigerator 100*b* in accordance with one or more embodiments may include a body 105 provided with the plurality of storage compartments 110, 120, and 130 formed thereto, and the cooling apparatus 170 (FIG. 3) to supply cool air to the plurality of storage compartments 110, 120, and 130. The structure of the body 105 and the cooling apparatus 170 are identical with respect to FIG. 1 to FIG. 3, and the overlapping descriptions will be omitted hereinafter.

The refrigerator 100*b* according to FIG. 14 may be provided with a refrigerating compartment fan 113*b* installed at an upper portion of the refrigerating compartment evaporator 176, and thus is different when compared to the refrigerator 100 from FIG. 1 to FIG. 3.

The refrigerating compartment fan 113*b* may be installed at a space provided in between an upper portion of the refrigerating compartment evaporator 176 and an upper surface of the cool air supplying unit 180 of the refrigerating compartment 110 so that the cool air heat-exchanged through the rear flow path 182 may be supplied at the refrigerating compartment 110.

That is, when the refrigerating compartment fan 113*b* is driven as to supply cool air at the refrigerating compartment 110, the cool air may flow in a clockwise direction while moving from a lower portion to an upper portion of the rear flow path 182.

The temperature converting compartment fan 123 while installed at a rear surface of the temperature converting compartment 120 may guide the cool air, which may be heat-exchanged through the front flow path 181, and the cool air, which is outlet from an outlet unit 121-2*b* of the rear cover 183, to an inside the temperature converting compartment 120.

The flow path structure in accordance with one or more embodiments is provided such that, even in a case when the refrigerating compartment fan 113*b* and the temperature converting compartment fan 123 are simultaneously driven, cool air may be provided to flow through each independent flow path, and this efficiency may be obtained with respect to supplying cool air.

The refrigerator 100*b* in accordance with one or more embodiments as well may simultaneously control the temperatures of the refrigerating compartment 110 and the temperature converting compartment 120, or may control the temperature of the temperature converting compartment 120 after controlling the temperature of the refrigerating compartment 110, and the controlling process of temperature of the refrigerating compartment 110 and the temperature converting compartment 120 is identical with respect to FIG. 7 to FIG. 12, and thus the overlapping descriptions will be omitted hereinafter.

Figure 15:
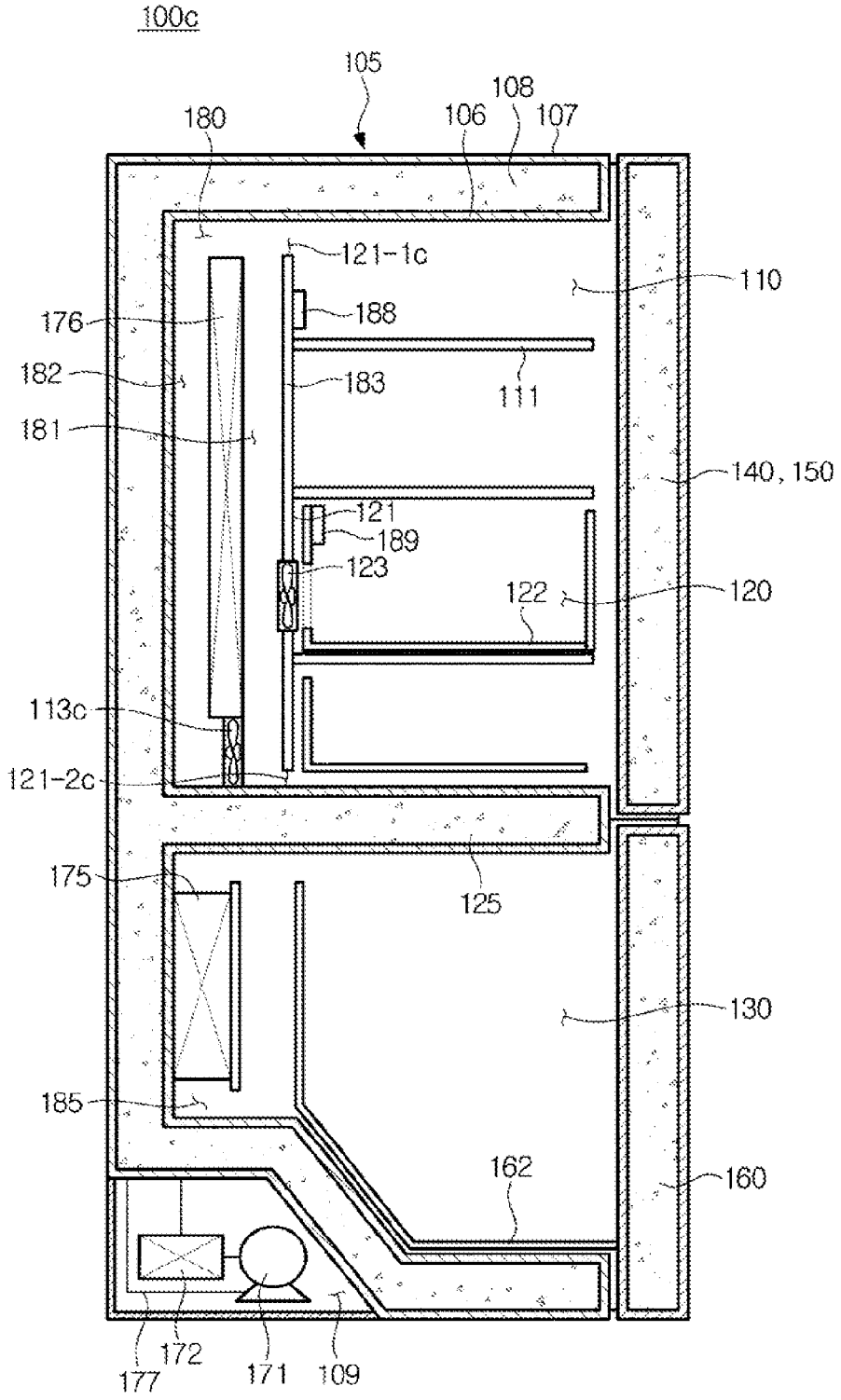
FIG. 15 is a drawing illustrating a cross-sectional view of a refrigerator in accordance with one or more embodiments.

FIG. 15 is a drawing illustrating a cross-sectional view of a refrigerator 100*c* in accordance with still another embodiment of the present disclosure.

Referring to FIG. 15, the refrigerator 100*c* in accordance with one or more embodiments may include a body 105 provided with the plurality of storage compartments 110, 120, and 130 formed thereto, and the cooling apparatus 170 (FIG. 3) to supply cool air to the plurality of storage compartments 110, 120, and 130. The structure of the body 105 and the cooling apparatus 170 are identical with respect to FIG. 1 to FIG. 3, and the overlapping descriptions will be omitted hereinafter.

The refrigerator 100*c* according to FIG. 15 may be provided with a refrigerating compartment fan 113*c* installed at a lower portion of the refrigerating compartment evaporator 176, and thus is different when compared to the refrigerator 100 from FIG. 1 to FIG. 3. However, the installation position of the refrigerating compartment fan 113*c* is not limited hereto, and the refrigerating compartment fan 113*c* may be installed at an upper portion and at a lower portion of the refrigerating compartment evaporator 176 so as to adjust the flow of cool air.

The refrigerating compartment fan 113*c* may be installed at a space provided in between a lower portion of the refrigerating compartment evaporator 175 and a lower surface of the cool air supplying unit 180 of the refrigerating compartment 110 so that the cool air heat-exchanged through the rear flow path 182 may be supplied at the refrigerating compartment 110.

That is, when the refrigerating compartment fan 113*c* is driven as to supply cool air at the refrigerating compartment 110, the cool air may flow in a clockwise direction while moving from a lower portion to an upper portion of the rear flow path 182.

The temperature converting compartment fan 123 while installed at a rear surface of the temperature converting compartment 120 may guide the cool air, which is heat-exchanged through the front flow path 181, and the cool air, which remains at the surrounding of an outlet unit 121-2*c* of the rear cover 183, to an inside the temperature converting compartment 120.

The refrigerator 100*c* in accordance with one or more embodiments as well may simultaneously control the temperatures of the refrigerating compartment 110 and the temperature converting compartment 120, or may control the temperature of the temperature converting compartment 120 after controlling the temperature of the refrigerating compartment 110, and the controlling process of temperature of the refrigerating compartment 110 and the temperature converting compartment 120 is identical with respect to FIG. 7 to FIG. 12, and thus the overlapping descriptions will be omitted hereinafter.

Figure 16:
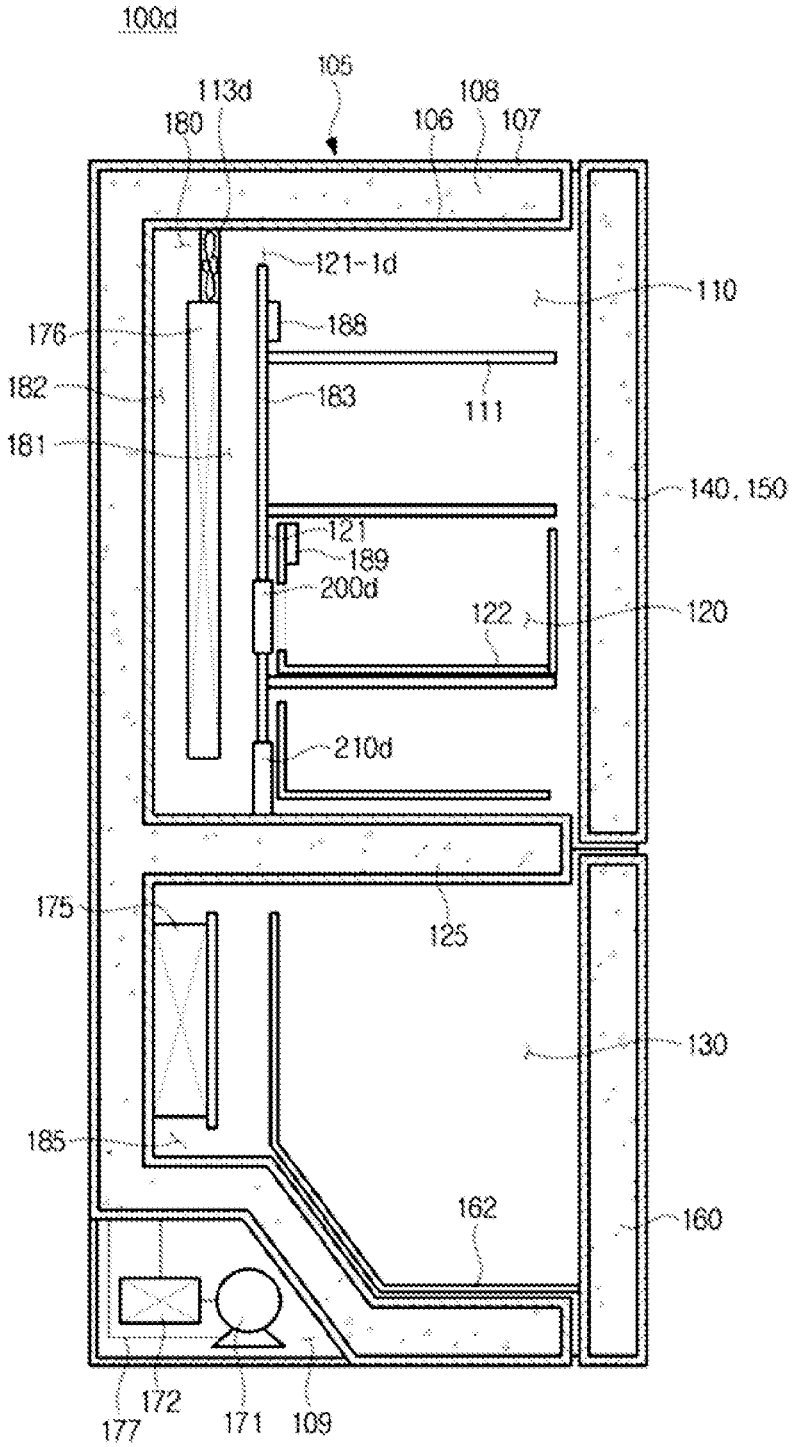
FIG. 16 is a drawing illustrating a cross-sectional view of a refrigerator in accordance with one or more embodiments.
Figure 17:
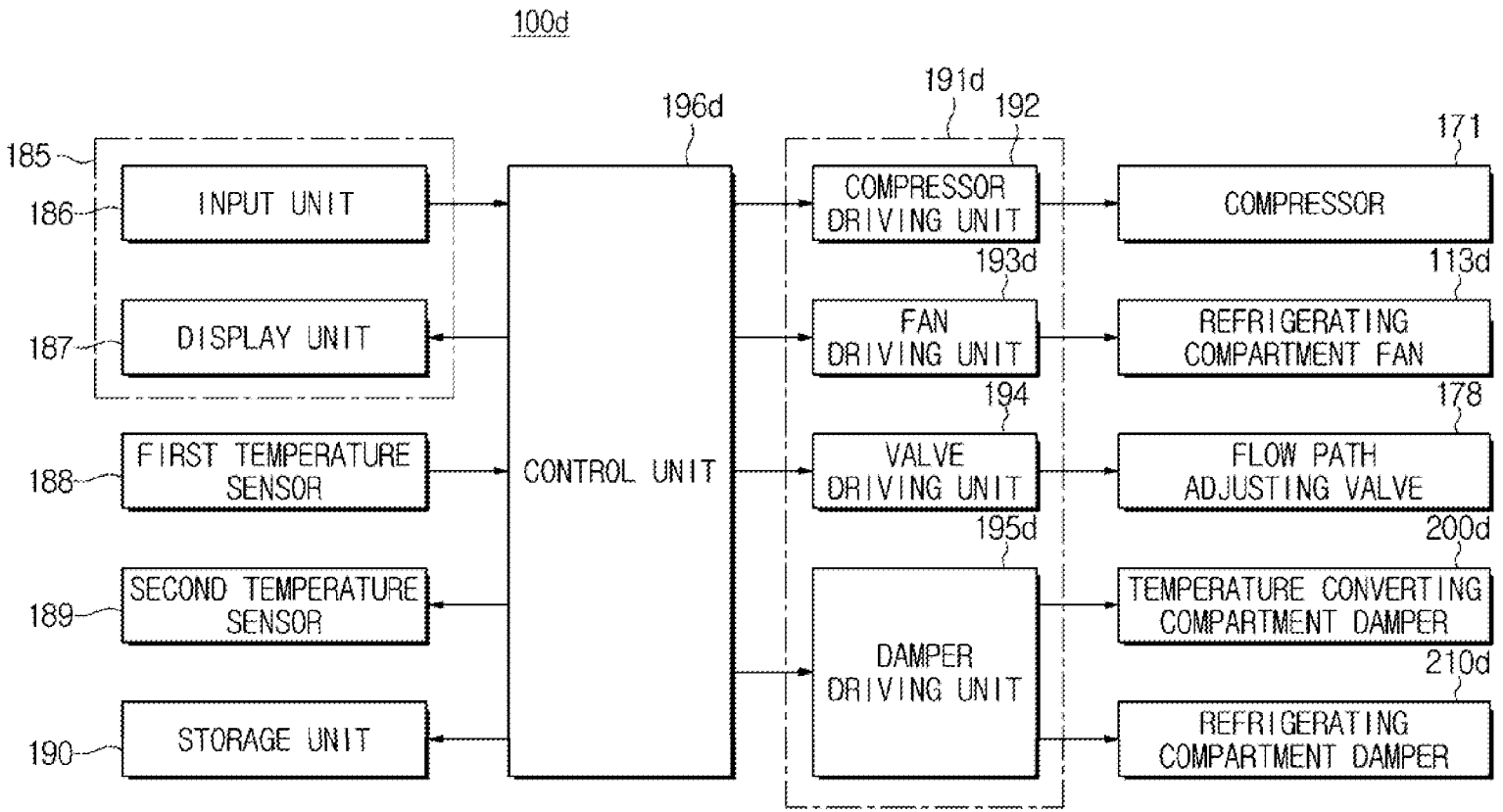
FIG. 17 is a drawing illustrating a block diagram of a refrigerator in accordance with one or more embodiments, such as the refrigerator of FIG. 16.

FIG. 16 is a drawing illustrating a cross-sectional view of a refrigerator 100*d* in accordance with one or more embodiments, and FIG. 17 is a drawing illustrating a block diagram of a refrigerator according to one or more embodiments, such as the refrigerator 100*d* of FIG. 16.

The refrigerator 100*d* according to FIG. 16 and FIG. 17 may include dampers 200*d* and 210*d* to communicate and shut off a flow of the cool air that flows along the cool air supplying unit 180, and thus is different when compared to the refrigerator 100 from FIG. 1 to FIG. 3.

Referring to FIG. 16 and FIG. 17, the refrigerator 100*d* may include the control panel 185, the first temperature sensor 188 to detect a temperature of the refrigerating compartment 110, the second temperature sensor 189 to detect a temperature of the temperature converting compartment 120, the storage unit 190, the a driver such as the driving unit 191 to drive the compressor 171, the temperature converting compartment damper 200*d*, the refrigerating compartment damper 210*d*, and the refrigerating compartment fan 113*d*, and a controller such as the control unit 196*d* to control a driving of the compressor 171, the temperature converting compartment damper 200*d*, the refrigerating compartment damper 210*d*, and the refrigerating compartment fan 113*d*.

With respect to the control panel 185, the first temperature sensor 188, the second temperature sensor 189, and the storage unit 190, the overlapping descriptions with respect to FIG. 6 will be omitted.

The driving unit 191*d* may include a compressor driver such as the compressor driving unit 192 to drive the compressor 171, a fan driver such as the fan driving unit 193*d* to drive the refrigerating compartment fan 113*d*, a valve driver such as the valve driving unit 194 to drive the flow path converting valve 178, and a damper driver such as the damper driving unit 195*d* to drive the temperature converting compartment damper 200*d* and the refrigerating compartment damper 210*d*.

The control unit 196*d* may be configured to control signal flows in between the inside component elements of the refrigerator 100*d* as well as general operations of the refrigerator 100*d*, and process data. The control unit 196*d* may execute an OS (Operating System) and various applications stored at the storage unit 190, in a case when an input of a user is made or predetermined conditions are satisfied.

The control unit 196*d* may be input with temperature setting commands of the refrigerator 100*d* from a user, or may execute the first and second temperature sensors 188 and 189 as well as various applications.

The control unit 196*d* may control the compressor 171, the refrigerating compartment fan 113*s*, the damper 200*d*, and the damper 210*d* if it is determined that a temperature setting command of the refrigerator 100*d* is input or if it is determined that the temperature of the refrigerating compartment 110 or the temperature converting compartment 120 is higher than a predetermined reference temperature as a result of the detection of the first and second temperature sensors 188 and 189.

In more detail, the control unit 196*d* may control components of the refrigerator such that cool air may be simultaneously supplied at the refrigerating compartment 110 and the temperature converting compartment 120 according to a pre-stored program, or may control the temperature of the temperature converting compartment 120 after controlling the temperature of the refrigerating compartment 110 by supplying cool air at the refrigerating compartment 110.

Hereinabove, the each component of the refrigerator 100*d* in accordance with one or more embodiments is described. Hereinafter, the controlling process of the refrigerator in accordance with one or more embodiments will be described.

Figure 18:
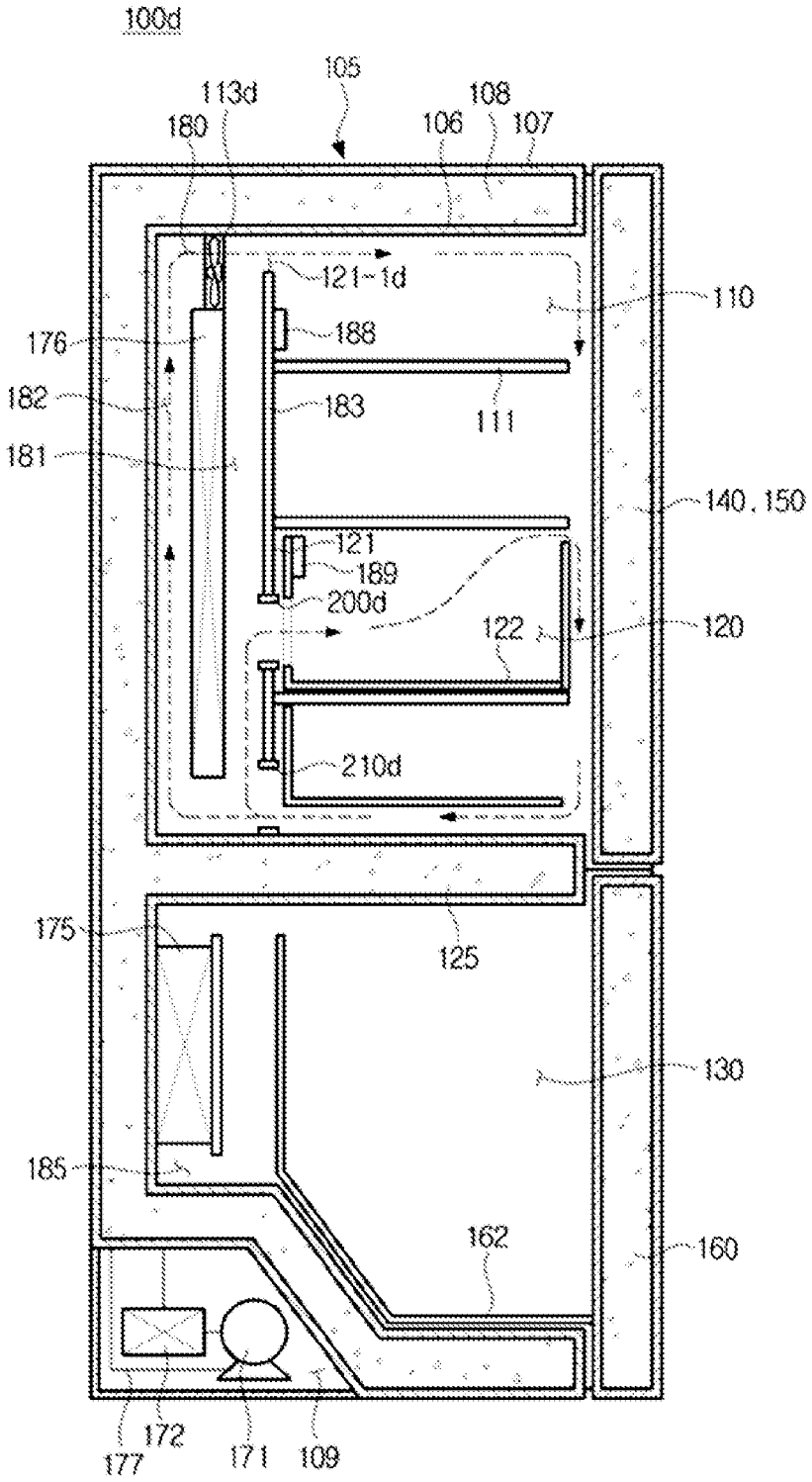
FIG. 18 and FIG. 19 are drawings illustrating a controlling process of a refrigerator in accordance with one or more embodiments.
Figure 19:
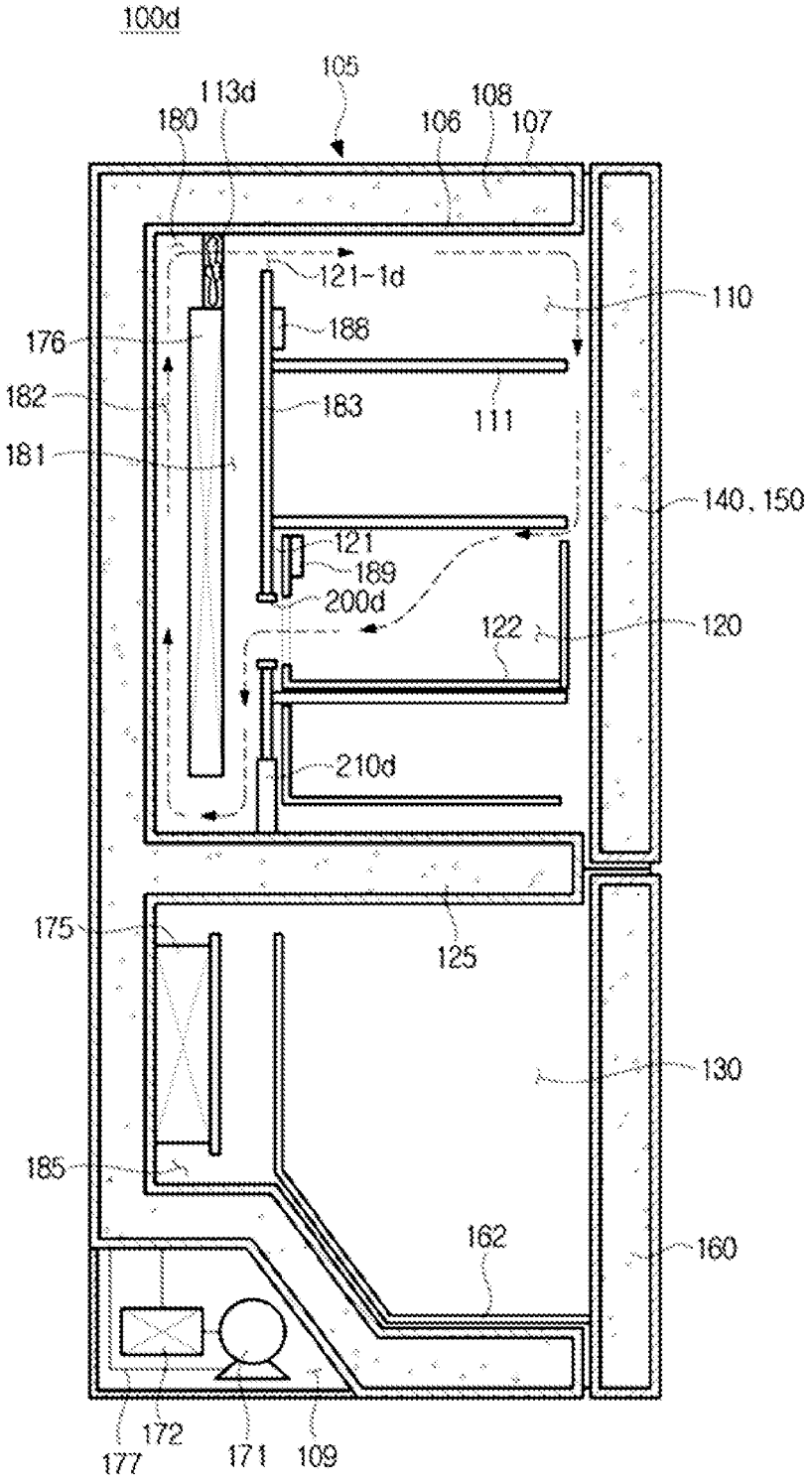
Figure 20:
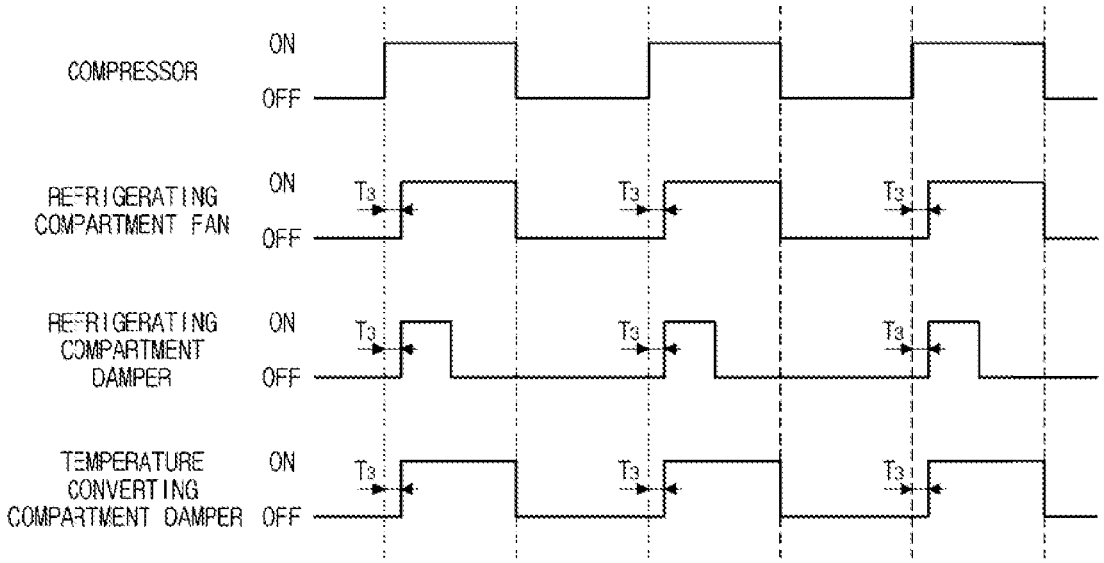
FIG. 20 is a graph showing operations of a refrigerator in accordance with one or more embodiments, such as the refrigerator according to FIG. 18 and FIG. 19.

FIG. 18 and FIG. 19 are drawings illustrating a controlling process of a refrigerator according to one or more embodiments, such as the refrigerator 100*d*, and FIG. 20 is a graph showing operations of a refrigerator according to one or more embodiments, such as the refrigerator 100*d* according to FIG. 18 and FIG. 19.

The controlling process of the refrigerator 100*d* in accordance with one or more embodiments may include a driving of the refrigerating compartment fan 113*d*, a simultaneously supplying of cool air at the refrigerating compartment 110 and the temperature converting compartment 120 by turning ON the temperature converting compartment damper 200*d* and the refrigerating compartment damper 210*d*, and a supplying of cool air at the temperature converting compartment 120 by turning OFF the refrigerating compartment damper 210*d* if determined that the temperature of the refrigerating compartment 110 is reached at a predetermined reference temperature.

In more detail, the first and second temperature sensors 188 and 189 may be provided to detect temperatures of the refrigerating compartment 110 and the temperature converting compartment 120 at a regular interval.

If determined that the temperature of the refrigerating compartment 110 is higher than the first reference temperature and that the temperature of the temperature converting compartment 120 is higher than the second reference temperature as a result of the detection, the compressor 171 and the refrigerating compartment fan 113*d* may be driven, and the temperature converting compartment damper 200*d* and the refrigerating compartment damper 210*d* may be turned ON.

In the controlling process in accordance with one or more embodiments as well, when a third time T3 is elapsed after the compressor 171 is driven, then the refrigerating compartment fan 113*d* may be driven. As the above, by driving the refrigerating compartment fan 113*d* after cool air is generated in some degree, cooling efficiency may be improved.

The refrigerating compartment fan 113*d* may be disposed at the upper portion of the refrigerating compartment evaporator 175, and thus when the refrigerating compartment fan 113*d* is driven, as illustrated on FIG. 18, a flow of cool air, which may flow in a clockwise direction while passing through the rear flow path 182, may be generated. The cool air may be mainly provided to flow in a clockwise direction through the cool air supplying unit 180 of the refrigerating compartment 110 and the refrigerating compartment 110 to supply the cool air at the refrigerating compartment 110, and a portion of the cool air may be inlet into an inside the temperature converting compartment 120 after passing through the temperature converting compartment damper 200*d*.

In general, the first reference temperature may be set to be higher than the second reference temperature, and thus the temperature of the refrigerating compartment 110 may be reached first at the first reference temperature. If determined that the temperature of the refrigerating compartment 110 is reached at the first reference temperature, the refrigerating compartment damper 210*d* may be converted into an OFF status. In a case when the second reference temperature is set to be higher than the first reference temperature, the same theory may be applied as well.

As the above, the cool air may be supplied at the temperature converting compartment 120 after being provided to flow in a clockwise direction through the rear flow path 182.

If it is determined that the temperature of the temperature converting compartment 120 is reached at the second reference temperature, the operations of the compressor 170 and the refrigerating compartment fan 113*d* may be stopped, and the temperature converting compartment damper 200*d* may be converted into an OFF status.

When the third time T3 is elapsed after the compressor 171 is driven, the refrigerating compartment fan 113*d* may be driven. Then, the temperature converting compartment damper 200*d* and the refrigerating compartment damper 210*d* may be converted into an ON status.

When the temperature of the refrigerating compartment 110 is reached at the first reference temperature, the refrigerating compartment damper 210*d* may be converted into an OFF status, and then when the temperature of the temperature converting compartment 120 is reached at the second reference temperature, the driving of the compressor 171 and the refrigerating compartment fan 113*d* may be stopped and the refrigerating compartment damper 210*d* may be converted into an OFF status.

The process above may be performed repeatedly, and cool air may be supplied at the refrigerating compartment 110 and the temperature converting compartment 120.

Figure 21:
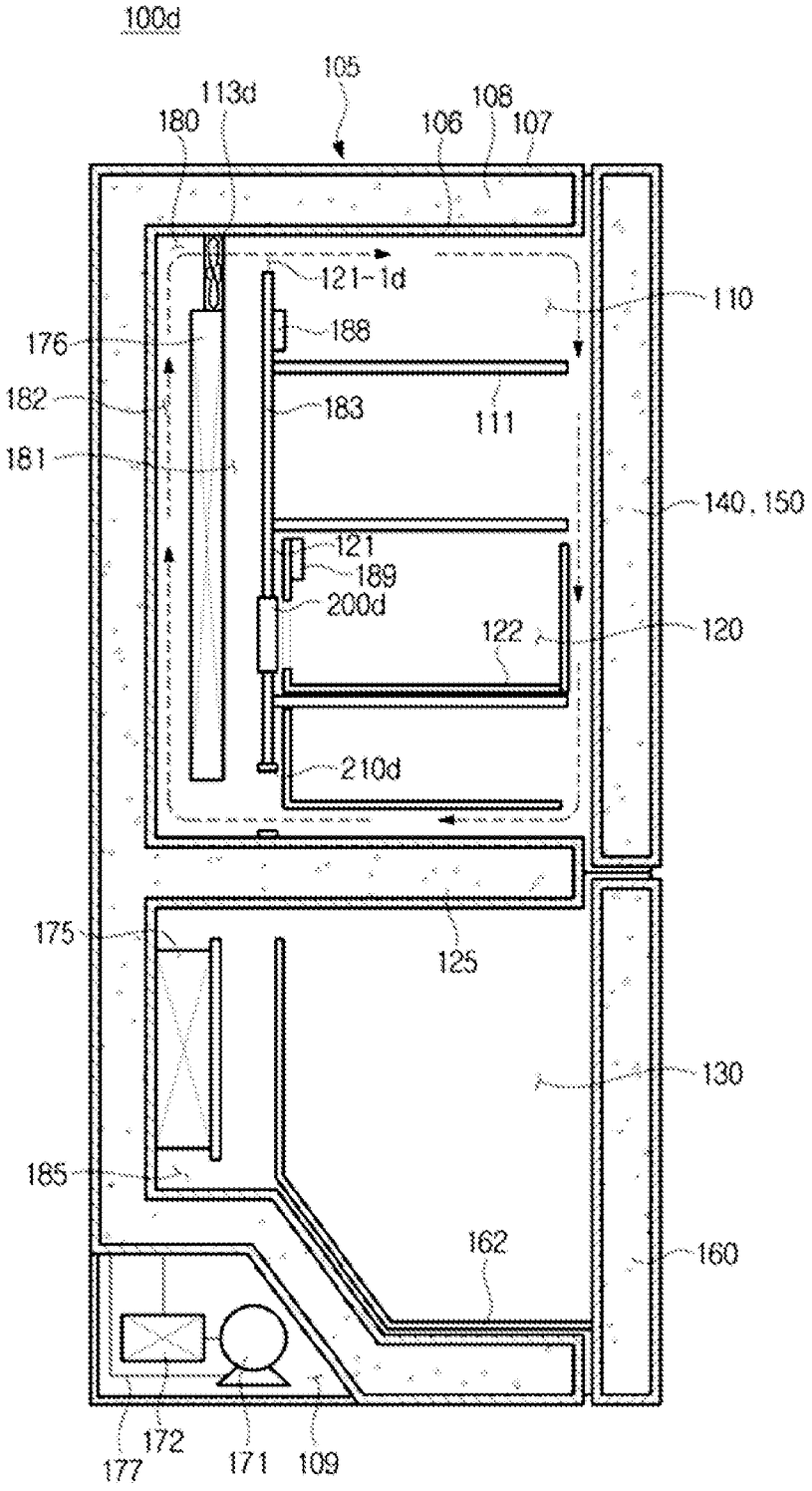
FIG. 21 and FIG. 22 are drawings illustrating a controlling process of a refrigerator in accordance with one or more embodiments.
Figure 22:
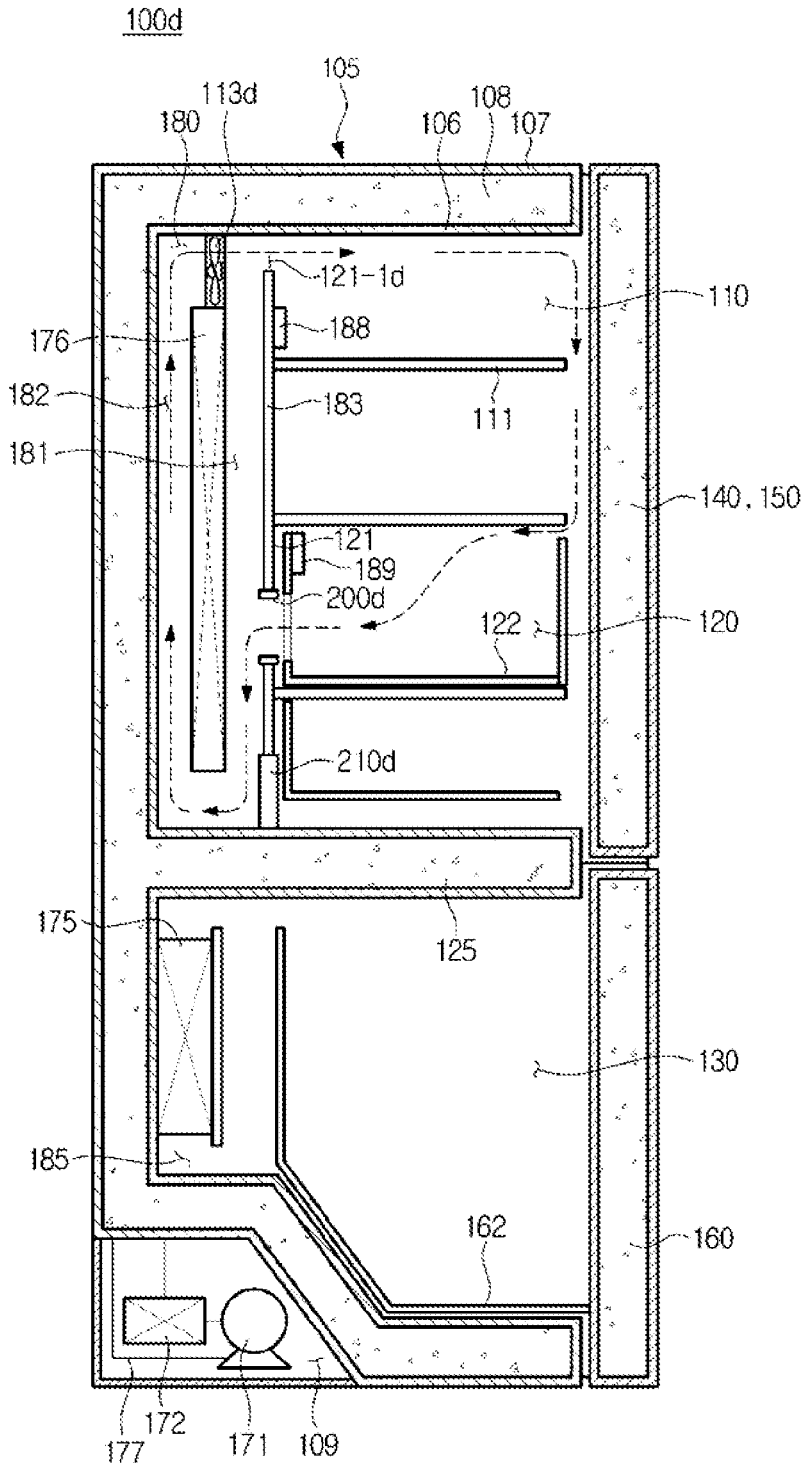
Figure 23:
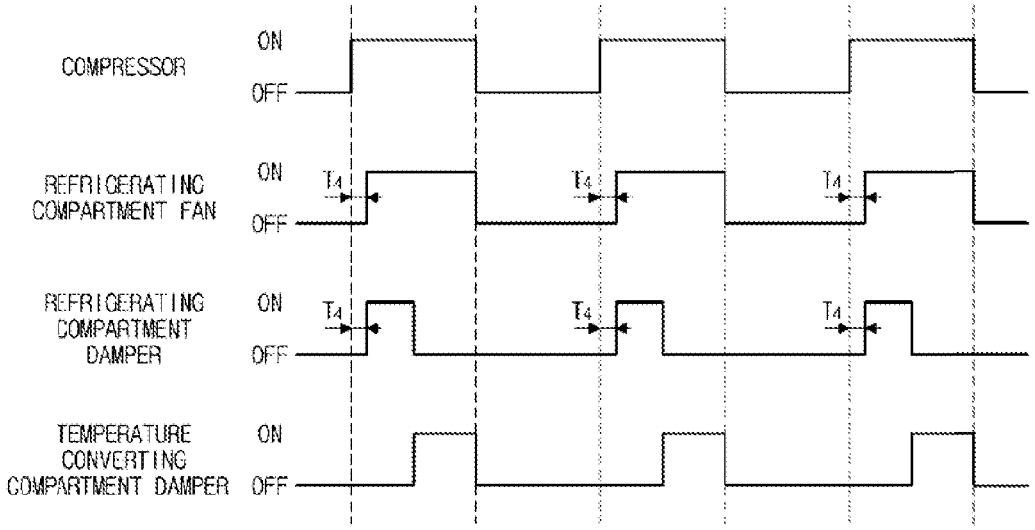
FIG. 23 is a graph showing operations of a refrigerator in accordance with one or more embodiments, such as the refrigerator according to FIG. 21 and FIG. 22.

FIG. 21 and FIG. 22 are drawings illustrating a controlling process of a refrigerator according to one or more embodiments, such as the refrigerator 100*d*, and FIG. 23 is a graph showing operations of a refrigerator according to one or more embodiments, such as the refrigerator 100*d* according to FIG. 21 and FIG. 22.

The controlling process of the refrigerator 100*d* in accordance with one or more embodiments may include a driving of the compressor 171 and the refrigerating compartment fan 113*d* and at the same time, a maintaining of the temperature converting compartment damper 200*d* in an OFF status and a maintaining of the refrigerating compartment damper 210*d* in an ON status as to supply cool air; and, if it is determined that the temperature of the refrigerating compartment 110 is reached at the predetermined first reference temperature, a converting of the temperature converting compartment damper 200*d* into an ON status and a converting of the refrigerating compartment damper 210*d* into a OFF status as to supply cool air to the temperature converting compartment 120.

In more detail, the first and second temperature sensors 188 and 189 may be provided to detect temperatures of the refrigerating compartment 110 and the temperature converting compartment 120 at a regular interval.

If it is determined that the temperature of the refrigerating compartment 110 is higher than the first reference temperature and that the temperature of the temperature converting compartment 120 is higher than the second reference temperature as a result of the detection, the compressor 171 and the refrigerating compartment fan 113*d* may be driven, and the temperature converting compartment damper 200*d* may be maintained in an OFF status and the refrigerating compartment damper 210*d* may be converted into an ON status.

In the controlling process in accordance with one or more embodiments, when a fourth time T4 is elapsed after the compressor is driven, the refrigerating compartment fan 113*d* may be driven. Then, the refrigerating compartment damper 200*d* may be converted into an ON status. As the above, by driving the refrigerating compartment fan 113*d* and the refrigerating compartment damper 210*d* after cool air is generated in some degree, cooling efficiency may be improved.

The refrigerating compartment fan 113*d* may be disposed at the upper portion of the refrigerating compartment evaporator 175, and thus when the refrigerating compartment fan 113*d* is driven, as illustrated on FIG. 22, a flow of cool air, which may flow in a clockwise direction while passing through the rear flow path 182 of the cool air supplying unit 180 and through the refrigerating compartment 110, may be generated.

When the temperature of the refrigerating compartment 110 is reached at the first reference temperature, the refrigerating compartment damper 210*d* may be converted into an OFF status, and the temperature converting compartment damper 200*d* may be converted into an ON status. Cool air may be passed though the rear flow path 182 and may be supplied to an inside the refrigerating compartment 110 and then may be introduced into the temperature converting compartment 120, and may be introduced again into the rear flow path 182 after passing through the temperature converting compartment 200*d*. If determined that the temperature of the temperature converting compartment 120 is reached at the second reference temperature, the operations of the compressor 171 and the refrigerating compartment fan 113*d* may be stopped, and the temperature converting compartment 200*d* is converted into an OFF status.

The controlling process of the compressor 171, the refrigerating compartment fan 113*d*, the refrigerating compartment damper 210*d*, and the temperature converting compartment 200*d* is illustrated on FIG. 23.

When the compressor 171 is driven, the refrigerating compartment fan 113*d* may be driven after the fourth time T4 is elapsed, and then the refrigerating compartment damper 210*d* may be converted into an ON status. When the temperature of the refrigerating compartment 110 is reached at the first reference temperature, the refrigerating compartment damper 210*d* may be converted into an OFF status, and the temperature converting compartment damper 200*d* may be converted into an ON status. When the temperature of the temperature converting compartment 120 is reached at the second reference temperature as cool air is supplied into an inside the temperature converting compartment 120, the compressor 171 and the refrigerating compartment fan 113*d* may be converted into an OFF status and the temperature converting compartment damper 200*d* may be converted into an OFF status.

FIG. 16 to FIG. 23 are provided with an example of a case of the refrigerating compartment fan 113*d* installed at an upper portion of the refrigerating compartment evaporator 176, but the installation position and the number of the refrigerating compartment fan 113 are not limited hereto. The installation position of the refrigerating compartment damper 210*d* as well may be determined differently according to the installation position of the refrigerating compartment fan 113*d*. A temperature converting compartment fan (not shown), other than the temperature converting compartment damper 200*d*, may be installed simultaneously at the temperature converting compartment 120.

Hereinabove, the refrigerator 100*d* having a plurality of flow path and a controlling process thereof are described. Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator, comprising:

a storage compartment, a temperature converting compartment provided inside the storage compartment, and having a setting temperature that is different from a setting temperature of the storage compartment;

a cool air supplier provided at a rear of the storage compartment to supply cool air to at least one of the storage compartment and the temperature converting compartment; and a cover provided at a rear surface of the storage compartment to separate the cool air supplier from the storage compartment, the cover having a plurality of openings, wherein:

the cool air supplier comprises:

a heat-exchanger, a front flow path and a rear flow path, divided by the heat-exchanger and through which the cool air is to flow, a first fan allowing the cool air from the front flow path and the rear flow path to flow to the storage compartment through a first opening of the plurality openings, a second fan allowing the cool air from the front flow path to flow to the temperature converting compartment through a second opening of the plurality openings, and wherein the cool air from the front flow path and the rear flow path flows in a first direction when the first fan operates, and the cool air from the front flow path flows in a second direction when the second fan operates.

2. The refrigerator of claim 1, wherein:

the heat-exchanger comprises an evaporator.

3. The refrigerator of claim 2, wherein:

the evaporator comprises a roll-bond type evaporator.

4. The refrigerator of claim 1, wherein:

the at least one fan comprises a temperature converting compartment fan provided at one side of the temperature converting compartment to adjust the flow of cool air flowing to the temperature converting compartment.

5. The refrigerator of claim 4, wherein:

the temperature converting compartment fan supplies the cool air to the temperature converting compartment from the front flow path.

6. The refrigerator of claim 1, wherein:

the first fan includes a fan provided on at least one of an upper side and a lower side of the heat-exchanger.

7. The refrigerator of claim 1, wherein:

the first fan includes a fan on at least one of an upper side or a lower side of the rear cover.

8. A refrigerator comprising:

a storage compartment;

a temperature converting compartment provided inside the storage compartment, and having a setting temperature that is different from a setting temperature of the storage compartment;

a cool air supplier provided at a rear of the storage compartment to supply cool air to at least one of the storage compartment and the temperature converting compartment; and a cover provided at a rear surface of the storage compartment to separate the cool air supplier from the storage compartment, the cover having a plurality of openings, wherein the cool air supplier comprises:

a heat-exchanger, a front flow path and a rear flow path, divided by the heat-exchanger and through which the cool air is to flow, a fan allowing the cool air from at least one of the front flow path and the rear flow path to flow to the storage compartment through a first opening of the plurality openings, and a damper provided at a second opening of the plurality openings to selectively communicate or shut off the flow of cool air flowing from the front flow path to the temperature converting compartment through the second opening.

9. The refrigerator of claim 8, wherein:

the damper is formed on one side of the temperature converting compartment.

10. The refrigerator of claim 1, further comprising:

a first temperature sensor configured to detect a temperature of the storage compartment;

a second temperature sensor configured to detect a temperature of the temperature converting compartment;

a controller configured to control an operation of the first fan based on the setting temperature of the storage compartment and the temperature detected by the first temperature sensor, and to control an operation of the second fan based on the setting temperature of the temperature converting compartment and the temperature detected by the second temperature sensor.

11. The refrigerator of claim 10, wherein, when the temperature detected by the first temperature sensor is higher than the setting temperature of the storage compartment, the controller controls a driving of the first fan, when the temperature detected by the first temperature sensor is the setting temperature of the storage compartment, the controller stops the driving of the first fan, and controls a driving of the second fan, and when the temperature detected by the second temperature sensor is the setting temperature of the temperature converting compartment, the controller stops the driving of the second fan.

12. The refrigerator of claim 10, wherein, when the first fan and the second fan are driven simultaneously, the controller controls a rotational speed of the second fan to be a first rotational speed, and when the first fan stops and the second fan is driven, the controller controls a rotational speed of the second fan to be a second rotational speed that is faster than the first rotational speed.

* * * * *